US010891828B2

(12) United States Patent
Arnone et al.

(10) Patent No.: US 10,891,828 B2
(45) **Date of Patent: *Jan. 12, 2021**

(54) HEAD TO HEAD SYSTEMS

(71) Applicant: Gamblit Gaming, LLC, Glendale, CA (US)

(72) Inventors: Miles Arnone, Sherborn, MA (US); Eric Meyerhofer, Pasadena, CA (US); Caitlyn Ross, Watertown, MA (US)

(73) Assignee: Gamblit Gaming, LLC, Monrovia, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/209,188

(22) Filed: Dec. 4, 2018

(65) Prior Publication Data

US 2019/0108730 A1 Apr. 11, 2019

Related U.S. Application Data

(63) Continuation of application No. 15/450,287, filed on Mar. 6, 2017, now Pat. No. 10,147,277, which is a (Continued)

(51) Int. Cl.

| | |
|---|---|
| ***A63F 9/24*** | (2006.01) |
| ***G07F 17/32*** | (2006.01) |
| ***G07F 17/34*** | (2006.01) |

(52) U.S. Cl.

CPC ..... *G07F 17/3279* (2013.01); *G07F 17/3225* (2013.01); *G07F 17/3227* (2013.01); (Continued)

(58) Field of Classification Search

CPC .... A63F 13/12; G07F 17/3244; G07F 17/326; G07F 17/3267; G07F 17/3279; G07F 17/3248

See application file for complete search history.

(56) References Cited

U.S. PATENT DOCUMENTS 5,413,357 A 5/1995 Schulze et al.
5,718,429 A 2/1998 Keller
(Continued)

FOREIGN PATENT DOCUMENTS

JP 2001300098 A 10/2001
JP 2003111980 A 4/2003
(Continued)

OTHER PUBLICATIONS

U.S. Appl. No. 15/362,660 Arnone, et al. filed Nov. 28, 2016.
(Continued)

*Primary Examiner* — Steve Rowland
(74) *Attorney, Agent, or Firm* — Frank Cire

(57) ABSTRACT

An electromechanical gaming machine including: a real world controller connected to a game world controller, and constructed to: accept a gambling game trigger; provide a randomly generated payout of credits; the game world controller connected to the real world controller and connected by a network to an entertainment software controller executing a multiplayer entertainment game, the game world controller constructed to: receive a plurality of players' actions taken; and trigger the wager in the gambling game based on the actions, the game world controller utilizing a head to head gambling controller constructed to: detect a latch event and enter the plurality of players into a gambling session; parameterize wager terms of the wager made; trigger the wager in the gambling game during the session; distribute the payout of credits; determine the payout of resources utilized by the plurality of players; and distribute the payout of resources.

20 Claims, 13 Drawing Sheets

Related U.S. Application Data continuation of application No. 14/727,726, filed on Jun. 1, 2015, now Pat. No. 9,589,421, which is a continuation of application No. 14/104,897, filed on Dec. 12, 2013, now Pat. No. 9,047,735, which is a continuation of application No. PCT/US2013/020479, filed on Jan. 7, 2013.

(60) Provisional application No. 61/631,524, filed on Jan. 5, 2012.

(52) U.S. Cl.
CPC ..... *G07F 17/3244* (2013.01); *G07F 17/3276* (2013.01); *G07F 17/3295* (2013.01); *G07F 17/34* (2013.01)

(56) References Cited

U.S. PATENT DOCUMENTS 5,785,592 A 7/1998 Jacobsen
5,853,324 A 12/1998 Kami et al.
5,963,745 A 10/1999 Collins et al.
6,050,895 A 4/2000 Luciano
6,165,071 A 12/2000 Weiss
6,227,974 B1 5/2001 Eilat
6,267,669 B1 7/2001 Luciano
6,302,791 B1 10/2001 Frohm et al.
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,931,531 B2 4/2011 Oberberger
7,938,727 B1 5/2011 Konkle
7,950,993 B2 5/2011 Oberberger
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Dram
8,137,193 B1 3/2012 Kelly et al.
8,142,272 B2 3/2012 Walker
8,157,653 B2 4/2012 Buhr
8,167,695 B2 5/2012 Rowe
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,430,735 B2 4/2013 Oberberger
8,475,266 B2 7/2013 Amone
8,480,470 B2 7/2013 Napolitano et al.
8,485,893 B2 7/2013 Rowe
8,622,809 B1 1/2014 Arora et al.
8,864,564 B2 10/2014 Oberberger
8,998,694 B2 4/2015 Rowe
9,070,257 B1 6/2015 Scalise
9,092,946 B2 7/2015 Rowe
9,111,412 B2 8/2015 Rowe
9,454,873 B2 9/2016 Rowe
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf
2003/0171149 A1 9/2003 Rothschild
2003/0204565 A1 10/2003 Guo et al.
2003/0211879 A1 11/2003 Englman
2004/0092313 A1 5/2004 Saito et al.
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow

(56) References Cited

U.S. PATENT DOCUMENTS

| | | | |
|---|---|---|---|
| 2008/0096665 | A1 | 4/2008 | Cohen |
| 2008/0108406 | A1 | 5/2008 | Oberberger |
| 2008/0108425 | A1 | 5/2008 | Oberberger |
| 2008/0113704 | A1 | 5/2008 | Jackson |
| 2008/0119283 | A1 | 5/2008 | Baerlocher |
| 2008/0146308 | A1 | 6/2008 | Okada |
| 2008/0161081 | A1 | 7/2008 | Berman |
| 2008/0176619 | A1 | 7/2008 | Kelly |
| 2008/0191418 | A1 | 8/2008 | Lutnick et al. |
| 2008/0195481 | A1 | 8/2008 | Lutnick |
| 2008/0248850 | A1 | 10/2008 | Schugar |
| 2008/0254893 | A1 | 10/2008 | Patel |
| 2008/0274796 | A1 | 11/2008 | Lube |
| 2008/0274798 | A1 | 11/2008 | Walker et al. |
| 2008/0311980 | A1 | 12/2008 | Cannon |
| 2008/0318668 | A1 | 12/2008 | Ching |
| 2009/0011827 | A1 | 1/2009 | Englman |
| 2009/0023489 | A1 | 1/2009 | Toneguzzo |
| 2009/0023492 | A1 | 1/2009 | Erfanian |
| 2009/0061974 | A1 | 3/2009 | Lutnick et al. |
| 2009/0061975 | A1 | 3/2009 | Ditchev |
| 2009/0061991 | A1 | 3/2009 | Popovich |
| 2009/0061997 | A1 | 3/2009 | Popovich |
| 2009/0061998 | A1 | 3/2009 | Popovich |
| 2009/0061999 | A1 | 3/2009 | Popovich |
| 2009/0082093 | A1 | 3/2009 | Okada |
| 2009/0088239 | A1 | 4/2009 | Iddings |
| 2009/0098934 | A1 | 4/2009 | Amour |
| 2009/0118006 | A1 | 5/2009 | Kelly et al. |
| 2009/0124344 | A1 | 5/2009 | Mitchell et al. |
| 2009/0131158 | A1 | 5/2009 | Brunet De Courssou et al. |
| 2009/0131175 | A1 | 5/2009 | Kelly et al. |
| 2009/0143141 | A1 | 6/2009 | Wells |
| 2009/0149233 | A1 | 6/2009 | Strause et al. |
| 2009/0156297 | A1 | 6/2009 | Andersson et al. |
| 2009/0176560 | A1 | 7/2009 | Herrmann et al. |
| 2009/0176566 | A1 | 7/2009 | Kelly |
| 2009/0181777 | A1 | 7/2009 | Christiani |
| 2009/0247272 | A1 | 8/2009 | Abe |
| 2009/0221355 | A1 | 9/2009 | Dunaevsky et al. |
| 2009/0239610 | A1 | 9/2009 | Olive |
| 2009/0270164 | A1 | 10/2009 | Seelig |
| 2009/0275393 | A1 | 11/2009 | Kisenwether |
| 2009/0291755 | A1 | 11/2009 | Walker et al. |
| 2009/0309305 | A1 | 12/2009 | May |
| 2009/0312093 | A1 | 12/2009 | Walker et al. |
| 2009/0325686 | A1 | 12/2009 | Davis |
| 2010/0004058 | A1 | 1/2010 | Acres |
| 2010/0016056 | A1 | 1/2010 | Thomas et al. |
| 2010/0029373 | A1 | 2/2010 | Graham |
| 2010/0035674 | A1 | 2/2010 | Slomiany |
| 2010/0056247 | A1 | 3/2010 | Nicely |
| 2010/0056260 | A1 | 3/2010 | Fujimoto |
| 2010/0062836 | A1 | 3/2010 | Young |
| 2010/0093420 | A1 | 4/2010 | Wright |
| 2010/0093444 | A1 | 4/2010 | Biggar et al. |
| 2010/0105454 | A1 | 4/2010 | Weber |
| 2010/0120525 | A1 | 5/2010 | Baerlocher et al. |
| 2010/0124983 | A1 | 5/2010 | Gowin et al. |
| 2010/0137047 | A1 | 6/2010 | Englman et al. |
| 2010/0174593 | A1 | 7/2010 | Cao |
| 2010/0184509 | A1 | 7/2010 | Sylla et al. |
| 2010/0203940 | A1 | 8/2010 | Alderucci et al. |
| 2010/0210344 | A1 | 8/2010 | Edidin et al. |
| 2010/0227672 | A1 | 9/2010 | Amour |
| 2010/0227688 | A1 | 9/2010 | Lee |
| 2010/0240436 | A1 | 9/2010 | Wilson et al. |
| 2010/0285869 | A1 | 11/2010 | Walker |
| 2010/0304825 | A1 | 12/2010 | Davis |
| 2010/0304839 | A1 | 12/2010 | Johnson |
| 2010/0304842 | A1 | 12/2010 | Friedman et al. |
| 2011/0009177 | A1 | 1/2011 | Katz |
| 2011/0009178 | A1 | 1/2011 | Gerson |
| 2011/0045896 | A1 | 2/2011 | Sak et al. |
| 2011/0070945 | A1 | 3/2011 | Walker |
| 2011/0077087 | A1 | 3/2011 | Walker et al. |
| 2011/0082571 | A1 | 4/2011 | Murdock et al. |
| 2011/0105206 | A1 | 5/2011 | Rowe |
| 2011/0107239 | A1 | 5/2011 | Adoni |
| 2011/0111820 | A1 | 5/2011 | Filipour |
| 2011/0111837 | A1 | 5/2011 | Gagner |
| 2011/0111841 | A1 | 5/2011 | Tessmer |
| 2011/0118011 | A1 | 5/2011 | Filipour et al. |
| 2011/0109454 | A1 | 6/2011 | McSheffrey |
| 2011/0201413 | A1 | 8/2011 | Oberberger |
| 2011/0207523 | A1 | 8/2011 | Filipour et al. |
| 2011/0212758 | A1 | 9/2011 | Kane |
| 2011/0212766 | A1 | 9/2011 | Bowers |
| 2011/0212767 | A1 | 9/2011 | Barclay |
| 2011/0218028 | A1 | 9/2011 | Acres |
| 2011/0218035 | A1 | 9/2011 | Thomas |
| 2011/0230258 | A1 | 9/2011 | Van Luchene |
| 2011/0230260 | A1 | 9/2011 | Morrow et al. |
| 2011/0230267 | A1 | 9/2011 | Van Luchene |
| 2011/0244935 | A1 | 10/2011 | Matthews et al. |
| 2011/0244944 | A1 | 10/2011 | Baerlocher |
| 2011/0263312 | A1 | 10/2011 | De Waal |
| 2011/0269522 | A1 | 11/2011 | Nicely et al. |
| 2011/0275440 | A1 | 11/2011 | Faktor |
| 2011/0287828 | A1 | 11/2011 | Anderson et al. |
| 2011/0287841 | A1 | 11/2011 | Watanabe |
| 2011/0312408 | A1 | 12/2011 | Okuaki |
| 2011/0319169 | A1 | 12/2011 | Lam |
| 2012/0004747 | A1 | 1/2012 | Kelly |
| 2012/0028718 | A1 | 2/2012 | Barclay et al. |
| 2012/0058814 | A1 | 3/2012 | Lutnick |
| 2012/0077569 | A1 | 3/2012 | Watkins |
| 2012/0108323 | A1 | 5/2012 | Kelly |
| 2012/0135793 | A1 | 5/2012 | Antonopoulos |
| 2012/0202587 | A1 | 8/2012 | Allen |
| 2012/0302311 | A1 | 11/2012 | Luciano |
| 2012/0322545 | A1 | 12/2012 | Arnone et al. |
| 2013/0029760 | A1 | 1/2013 | Wickett |
| 2013/0131848 | A1 | 5/2013 | Arnone et al. |
| 2013/0190074 | A1 | 7/2013 | Arnone et al. |
| 2013/0260869 | A1 | 10/2013 | Leandro et al. |
| 2014/0087801 | A1 | 3/2014 | Nicely et al. |
| 2014/0087808 | A1 | 3/2014 | Leandro et al. |
| 2014/0087809 | A1 | 3/2014 | Leupp et al. |
| 2014/0357350 | A1 | 12/2014 | Weingardt et al. |
| 2017/0148271 | A1 | 5/2017 | Graboyes Goldman et al. |

FOREIGN PATENT DOCUMENTS

| | | | |
|---|---|---|---|
| JP | 2004097610 | A | 4/2004 |
| JP | 20040097610 | A1 | 5/2004 |
| JP | 2004166746 | A | 6/2004 |
| JP | 2008119469 | A | 5/2008 |
| WO | 9851384 | A1 | 11/1998 |
| WO | 2010087090 | A1 | 8/2010 |
| WO | 2011109454 | A1 | 9/2011 |
| WO | 2012139083 | A1 | 10/2012 |
| WO | 2013103940 | A1 | 7/2013 |
| WO | 2013103995 | A2 | 7/2013 |

OTHER PUBLICATIONS

U.S. Appl. No. 15/365,628 Arnone, et al. filed Nov. 30, 2016.
U.S. Appl. No. 15/367,541 Arnone, et al. filed Dec. 2, 2016.
U.S. Appl. No. 15/369,394 Arnone, et al. filed Dec. 5, 2016.
U.S. Appl. No. 15/370,425 Arnone, et al. filed Dec. 6, 2016.
U.S. Appl. No. 15/375,711 Arnone, et al. filed Dec. 12, 2016.
U.S. Appl. No. 15/387,117 Arnone, et al. filed Dec. 21, 2016.
U.S. Appl. No. 15/392,887 Arnone, et al. filed Dec. 28, 2016.
U.S. Appl. No. 15/393,212 Arnone, et al. filed Dec. 28, 2016.
U.S. Appl. No. 15/394,257 Arnone, et al. filed Dec. 29, 2016.
U.S. Appl. No. 15/396,352 Arnone, et al. filed Dec. 30, 2016.
U.S. Appl. No. 15/396,354 Arnone, et al. filed Dec. 30, 2016.
U.S. Appl. No. 15/396,365 Arnone, et al. filed Dec. 30, 2016.
U.S. Appl. No. 15/406,474 Arnone, et al. filed Jan. 13, 2017.
U.S. Appl. No. 15/413,322 Arnone, et al. filed Jan. 23, 2017.
U.S. Appl. No. 15/415,833 Arnone, et al. filed Jan. 25, 2017.

(56) References Cited

OTHER PUBLICATIONS

U.S. Appl. No. 15/417,030 Arnone, et al. filed Jan. 26, 2017.
U.S. Appl. No. 15/422,453 Arnone, et al. filed Feb. 1, 2017.
U.S. Appl. No. 15/431,631 Arnone, et al. filed Feb. 13, 2017.
U.S. Appl. No. 15/434,843 Arnone, et al. filed Feb. 16, 2017.
U.S. Appl. No. 15/439,499 Arnone, et al. filed Feb. 22, 2017.
U.S. Appl. No. 15/449,249 Arnone, et al. filed Mar. 3, 2017.
U.S. Appl. No. 15/449,256 Arnone, et al. filed Mar. 3, 2017.
U.S. Appl. No. 15/450,287 Arnone, et al. filed Mar. 6, 2017.
U.S. Appl. No. 15/456,079 Arnone, et al. filed Mar. 10, 2017.
U.S. Appl. No. 15/457,827 Arnone, et al. filed Mar. 13, 2017.
U.S. Appl. No. 15/458,490 Arnone, et al. filed Mar. 14, 2017.
U.S. Appl. No. 15/460,195 Arnone, et al. filed Mar. 15, 2017.
U.S. Appl. No. 15/463,725 Arnone, et al. filed Mar. 20, 2017.
U.S. Appl. No. 15/464,282 Arnone, et al. filed Mar. 20, 2017.
U.S. Appl. No. 15/465,521 Arnone, et al. filed Mar. 21, 2017.
U.S. Appl. No. 15/470,869 Arnone, et al. filed Mar. 27, 2017.
U.S. Appl. No. 15/473,523 Arnone, et al. filed Mar. 29, 2017.
U.S. Appl. No. 15/483,773 Arnone, et al. filed Apr. 10, 2017.
U.S. Appl. No. 15/489,343 Arnone, et al. filed Apr. 17, 2017.
U.S. Appl. No. 15/491,617 Arnone, et al. filed Apr. 19, 2017.
U.S. Appl. No. 15/583,295 Arnone, et al. filed May 1, 2017, 2017.
U.S. Appl. No. 15/589,780 Arnone, et al. filed May 8, 2017.
U.S. Appl. No. 15/597,123 Arnone, et al. filed May 16, 2017.
U.S. Appl. No. 15/597,812 Arnone, et al. filed May 17, 2017.
U.S. Appl. No. 15/599,590 Arnone, et al. filed May 19, 2017.
U.S. Appl. No. 15/605,688 Arnone, et al. filed May 25, 2017.
U.S. Appl. No. 15/605,705 Arnone, et al. filed May 25, 2017.
U.S. Appl. No. 15/626,754 Arnone, et al. filed Jun. 19, 2017.
U.S. Appl. No. 15/631,762 Arnone, et al. filed Jun. 23, 2017.
U.S. Appl. No. 15/632,478 Arnone, et al. filed Jun. 26, 2017.
U.S. Appl. No. 15/632,479 Arnone, et al. filed Jun. 26, 2017.
U.S. Appl. No. 15/632,943 Arnone, et al. filed Jun. 26, 2017.
U.S. Appl. No. 15/632,950 Arnone, et al. filed Jun. 26, 2017.
U.S. Appl. No. 15/641,119 Arnone, et al. filed Jul. 3, 2017.
U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.
U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/855,322 Arnone, et al. filed Sep. 15, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/867,809 Arnone, et al. filed Sep. 28, 2015.
U.S. Appl. No. 14/868,287 Arnone, et al. filed Sep. 28, 2015.
U.S. Appl. No. 14/868,364 Arnone, et al. filed Sep. 28, 2015.
U.S. Appl. No. 14/869,809 Arnone, et al. filed Sep. 29, 2015.
U.S. Appl. No. 14/869,819 Arnone, et al. filed Sep. 29, 2015.
U.S. Appl. No. 14/885,894 Arnone, et al. filed Oct. 16, 2015.
U.S. Appl. No. 14/919,665 Arnone, et al. filed Oct. 21, 2015.
U.S. Appl. No. 14/942,844 Arnone, et al. filed Nov. 16, 2015.
U.S. Appl. No. 14/942,883 Arnone, et al. filed Nov. 16, 2015.
U.S. Appl. No. 14/949,759 Arnone, et al. filed Nov. 23, 2015.
U.S. Appl. No. 14/952,758 Arnone, et al. filed Nov. 25, 2015.
U.S. Appl. No. 14/952,769 Arnone, et al. filed Nov. 25, 2015.
U.S. Appl. No. 14/954,922 Arnone, et al. filed Nov. 30, 2015.
U.S. Appl. No. 14/954,931 Arnone, et al. filed Nov. 30, 2015.
U.S. Appl. No. 14/955,000 Arnone, et al. filed Nov. 30, 2015.
U.S. Appl. No. 14/956,301 Arnone, et al. filed Dec. 1, 2015.
U.S. Appl. No. 14/965,231 Arnone, et al. filed Dec. 10, 2015.
U.S. Appl. No. 14/965,846 Arnone, et al. filed Dec. 10, 2015.
U.S. Appl. No. 14/981,640 Arnone, et al. filed Dec. 28, 2015.
U.S. Appl. No. 14/981,775 Arnone, et al. filed Dec. 28, 2015.
U.S. Appl. No. 14/984,943 Arnone, et al. filed Dec. 30, 2015.
U.S. Appl. No. 14/984,965 Arnone, et al. filed Dec. 30, 2015.
U.S. Appl. No. 14/984,978 Arnone, et al. filed Dec. 30, 2015.
U.S. Appl. No. 14/985,107 Arnone, et al. filed Dec. 30, 2015.
U.S. Appl. No. 14/995,151 Arnone, et al. filed Jan. 13, 2016.
U.S. Appl. No. 14/974,432 Arnone, et al. filed Dec. 18, 2015.
U.S. Appl. No. 14/997,413 Arnone, et al. filed Jan. 15, 2016.
U.S. Appl. No. 15/002,233 Arnone, et al. filed Jan. 20, 2016.
U.S. Appl. No. 15/005,944 Arnone, et al. filed Jan. 25, 2016.
U.S. Appl. No. 15/011,322 Arnone, et al. filed Jan. 29, 2016.
U.S. Appl. No. 15/051,535 Arnone, et al. filed Feb. 23, 2016.
U.S. Appl. No. 15/053,236 Arnone, et al. filed Feb. 25, 2016.
U.S. Appl. No. 15/057,095 Arnone, et al. filed Feb. 29, 2016.
U.S. Appl. No. 15/060,502 Arnone, et al. filed Mar. 3, 2016.
Intellectual Property Office of Singapore, Search Report, IPOS Application No. 11201403800T, dated Apr. 24, 2015.
IP Australia, Patent Examination Report No. 1, Australia Patent Application No. 2013207350, dated Aug. 20, 2015.
Intellectual Property Office of The Philippines, Substantive Examination Report, Patent Application No. 12014501564, dated Mar. 2, 2016.
U.S. Appl. No. 15/920,374 Arnone, et al. filed Mar. 13, 2018.
U.S. Appl. No. 15/920,380 Arnone, et al. filed Mar. 13, 2018.
U.S. Appl. No. 15/920,388 Arnone, et al. filed Mar. 13, 2018.
U.S. Appl. No. 15/920,390 Arnone, et al. filed Mar. 13, 2018.
U.S. Appl. No. 15/922,816 Arnone, et al. filed Mar. 15, 2018.
U.S. Appl. No. 15/922,905 Arnone, et al. filed Mar. 15, 2018.
U.S. Appl. No. 15/925,268 Arnone, et al. filed Mar. 19, 2018.
U.S. Appl. No. 15/925,751 Arnone, et al. filed Mar. 19, 2018.
U.S. Appl. No. 15/933,319 Arnone, et al. filed Mar. 22, 2018.
U.S. Appl. No. 15/935,956 Arnone, et al. filed Mar. 26, 2018.
U.S. Appl. No. 15/943,207 Arnone, et al. filed Apr. 2, 2018.
U.S. Appl. No. 15/948,607 Arnone, et al. filed Apr. 9, 2018.
U.S. Appl. No. 15/949,812 Arnone, et al. filed Apr. 10, 2018.
U.S. Appl. No. 15/951,155 Arnone, et al. filed Apr. 11, 2018.
U.S. Appl. No. 15/954,094 Arnone, et al. filed Apr. 16, 2018.
U.S. Appl. No. 15/954,136 Arnone, et al. filed Apr. 16, 2018.
U.S. Appl. No. 15/961,375 Arnone, et al. filed Apr. 24, 2018.
U.S. Appl. No. 15/961,382 Arnone, et al. filed Apr. 24, 2018.
U.S. Appl. No. 15/966,590 Arnone, et al. filed Apr. 30, 2018.
U.S. Appl. No. 15/968,723 Arnone, et al. filed May 1, 2018.
U.S. Appl. No. 15/971,288 Arnone, et al. filed May 4, 2018.
U.S. Appl. No. 15/978,087 Arnone, et al. filed May 11, 2018.
U.S. Appl. No. 15/979,391 Arnone, et al. filed May 14, 2018.
U.S. Appl. No. 15/984,168 Arnone, et al. filed May 18, 2018.
U.S. Appl. No. 15/991,576 Arnone, et al. filed May 29, 2018.
U.S. Appl. No. 15/991,594 Arnone, et al. filed May 29, 2018.
U.S. Appl. No. 15/996,906 Arnone, et al. filed Jun. 4, 2018.
U.S. Appl. No. 16/005,017 Arnone, et al. filed Jun. 11, 2018.
U.S. Appl. No. 16/005,108 Arnone, et al. filed Jun. 11, 2018.
U.S. Appl. No. 16/011,110 Arnone, et al. filed Jun. 18, 2018.
U.S. Appl. No. 16/011,116 Arnone, et al. filed Jun. 18, 2018.
U.S. Appl. No. 16/017,976 Arnone, et al. filed Jun. 25, 2018.
U.S. Appl. No. 16/025,380 Arnone, et al. filed Jul. 2, 2018.
U.S. Appl. No. 16/030,289 Arnone, et al. filed Jul. 9, 2018.
U.S. Appl. No. 16/030,294 Arnone, et al. filed Jul. 9, 2018.
U.S. Appl. No. 16/036,269 Arnone, et al. filed Jul. 16, 2018.
U.S. Appl. No. 16/036,388 Arnone, et al. filed Jul. 16, 2018.
U.S. Appl. No. 16/036,393 Arnone, et al. filed Jul. 16, 2018.
U.S. Appl. No. 16/036,925 Arnone, et al. filed Jul. 16, 2018.
U.S. Appl. No. 16/039,322 Arnone, et al. filed Jul. 18, 2018.
U.S. Appl. No. 16/040,485 Arnone, et al. filed Jul. 19, 2018.
U.S. Appl. No. 16/042,488 Arnone, et al. filed Jul. 23, 2018.
U.S. Appl. No. 16/042,493 Arnone, et al. filed Jul. 23, 2018.
U.S. Appl. No. 16/048,893 Arnone, et al. filed Jul. 30, 2018.
U.S. Appl. No. 16/049,029 Arnone, et al. filed Jul. 30, 2018.
U.S. Appl. No. 16/057,400 Arnone, et al. filed Aug. 7, 2018.
U.S. Appl. No. 16/057,403 Arnone, et al. filed Aug. 7, 2018.
U.S. Appl. No. 16/102,003 Arnone, et al. filed Aug. 13, 2018.
U.S. Appl. No. 16/102,010 Arnone, et al. filed Aug. 13, 2018.
U.S. Appl. No. 16/102,044 Arnone, et al. filed Aug. 13, 2018.
U.S. Appl. No. 15/063,365 Arnone, et al. filed Mar. 7, 2016.

(56) References Cited

OTHER PUBLICATIONS

U.S. Appl. No. 15/063,496 Arnone, et al. filed Mar. 7, 2016.
U.S. Appl. No. 15/073,602 Arnone, et al. filed Mar. 17, 2016.
U.S. Appl. No. 15/074,999 Arnone, et al. filed Mar. 18, 2016.
U.S. Appl. No. 15/077,574 Arnone, et al. filed Mar. 22, 2016.
U.S. Appl. No. 15/083,284 Arnone, et al. filed Mar. 28, 2016.
U.S. Appl. No. 15/091,395 Arnone, et al. filed Apr. 5, 2016.
U.S. Appl. No. 15/093,685 Arnone, et al. filed Apr. 7, 2016.
U.S. Appl. No. 15/098,287 Arnone, et al. filed Apr. 13, 2016.
U.S. Appl. No. 15/098,313 Arnone, et al. filed Apr. 13, 2016.
U.S. Appl. No. 15/130,101 Arnone, et al. filed Apr. 15, 2016.
U.S. Appl. No. 15/133,624 Arnone, et al. filed Apr. 20, 2016.
U.S. Appl. No. 15/134,852 Arnone, et al. filed Apr. 21, 2016.
U.S. Appl. No. 15/139,148 Arnone, et al. filed Apr. 26, 2016.
U.S. Appl. No. 15/141,784 Arnone, et al. filed Apr. 29, 2016.
U.S. Appl. No. 15/155,107 Arnone, et al. filed May 16, 2016.
U.S. Appl. No. 15/156,222 Arnone, et al. filed May 16, 2016.
U.S. Appl. No. 15/158,530 Arnone, et al. filed May 18, 2016.
U.S. Appl. No. 15/161,174 Arnone, et al. filed May 20, 2016.
U.S. Appl. No. 15/170,773 Arnone, et al. filed Jun. 1, 2016.
U.S. Appl. No. 15/174,995 Arnone, et al. filed Jun. 6, 2016.
U.S. Appl. No. 15/179,940 Arnone, et al. filed Jun. 10, 2016.
U.S. Appl. No. 15/189,797 Arnone, et al. filed Jun. 22, 2016.
U.S. Appl. No. 15/190,745 Arnone, et al. filed Jun. 23, 2016.
U.S. Appl. No. 15/191,050 Arnone, et al. filed Jun. 23, 2016.
U.S. Appl. No. 15/219,257 Arnone, et al. filed Jul. 25, 2016.
U.S. Appl. No. 15/227,881 Arnone, et al. filed Aug. 3, 2016.
U.S. Appl. No. 15/241,683 Arnone, et al. filed Aug. 19, 2016.
U.S. Appl. No. 15/245,040 Arnone, et al. filed Aug. 23, 2016.
U.S. Appl. No. 15/233,294 Arnone, et al. filed Aug. 24, 2016.
U.S. Appl. No. 15/252,190 Arnone, et al. filed Aug. 30, 2016.
U.S. Appl. No. 15/255,789 Arnone, et al. filed Sep. 2, 2016.
U.S. Appl. No. 15/261,858 Arnone, et al. filed Sep. 9, 2016.
U.S. Appl. No. 15/264,521 Arnone, et al. filed Sep. 13, 2016.
U.S. Appl. No. 15/264,557 Arnone, et al. filed Sep. 13, 2016.
U.S. Appl. No. 15/271,214 Arnone, et al. filed Sep. 20, 2016.
U.S. Appl. No. 15/272,318 Arnone, et al. filed Sep. 21, 2016.
U.S. Appl. No. 15/273,260 Arnone, et al. filed Sep. 22, 2016.
U.S. Appl. No. 15/276,469 Arnone, et al. filed Sep. 26, 2016.
U.S. Appl. No. 15/280,255 Arnone, et al. filed Sep. 29, 2016.
U.S. Appl. No. 15/286,922 Arnone, et al. filed Oct. 6, 2016.
U.S. Appl. No. 15/287,129 Arnone, et al. filed Oct. 6, 2016.
U.S. Appl. No. 15/289,648 Arnone, et al. filed Oct. 10, 2016.
U.S. Appl. No. 15/297,019 Arnone, et al. filed Oct. 18, 2016.
U.S. Appl. No. 15/298,533 Arnone, et al. filed Oct. 20, 2016.
U.S. Appl. No. 15/336,696 Arnone, et al. filed Oct. 27, 2016.
U.S. Appl. No. 15/339,898 Arnone, et al. filed Oct. 31, 2016.
U.S. Appl. No. 15/345,451 Arnone, et al. filed Nov. 7, 2016.
U.S. Appl. No. 14/799,481 Arnone, et al. filed Jul. 14, 2015.
U.S. Appl. No. 15/362,214 Arnone, et al. filed Nov. 28, 2016.
itl.nist.gov, Extreme Studentized Deviate Test, [online], Sep. 2010, Internet<URL:http://www.itl.nist.gov/div898/software/dataplot/refman1/auxillar/esd.htm>, entire document, National Institute of Standards and Technology (NIST), U.S. Department of Commerce.
Changing the Virtual Self: Avatar Transformations in Popular Games; Barr et al., Victoria Univ., NZ, 2006.
Real-Time Multimodal Human-Avatar Interaction; Li et al., IEEE (Video Technology) vol. 18, No. 4, 2008.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.

(56) References Cited

OTHER PUBLICATIONS

U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
U.S. Appl. No. 14/205,303 Arnone, et al., filed Mar. 11, 2014.
U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.
WIPO—ISA, International Search Report and Written Opinion, PCT/US13/20479, dated Mar. 14, 2013.
WIPO—IPEA, International Preliminary Report on Patentability, PCT/US13/20479, dated Nov. 14, 2013.
Japan Patent Office, First Office Action, Japan Patent Application No. 2014-551385, dated Jan. 31, 2017, Japan.
Japan Patent Office, Second Office Action, Japan Patent Application No. 2014-551385, dated Nov. 7, 2017, Japan.
Canadian Patent Office, First Office Action, Patent Application No. 2,860,656, dated Aug. 3, 2018.
Japan Patent Office, Third Office Action, Japan Patent Application No. 2014-551385, dated Sep. 11, 2018, Japan.
U.S. Appl. No. 16/108,049 Arnone, et al. filed Aug. 21, 2018.
U.S. Appl. No. 16/108,052 Arnone, et al. filed Aug. 21, 2018.
U.S. Appl. No. 16/108,056 Arnone, et al. filed Aug. 21, 2018.
U.S. Appl. No. 16/113,494 Arnone, et al. filed Aug. 27, 2018.
U.S. Appl. No. 16/113,612 Arnone, et al. filed Aug. 27, 2018.
U.S. Appl. No. 16/120,619 Arnone, et al. filed Sep. 4, 2018.
U.S. Appl. No. 16/120,691 Arnone, et al. filed Sep. 4, 2018.
U.S. Appl. No. 16/126,151 Arnone, et al. filed Sep. 10, 2018.
U.S. Appl. No. 16/126,547 Arnone, et al. filed Sep. 10, 2018.
U.S. Appl. No. 16/127,184 Arnone, et al. filed Sep. 10, 2018.
U.S. Appl. No. 16/128,364 Arnone, et al. filed Sep. 11, 2018.
U.S. Appl. No. 16/128,484 Arnone, et al. filed Sep. 11, 2018.
U.S. Appl. No. 16/129,752 Arnone, et al. filed Sep. 12, 2018.
U.S. Appl. No. 16/141,208 Arnone, et al. filed Sep. 25, 2018.
U.S. Appl. No. 16/141,222 Arnone, et al. filed Sep. 25, 2018.
U.S. Appl. No. 16/149,065 Arnone, et al. filed Oct. 1, 2018.
U.S. Appl. No. 16/149,675 Arnone, et al. filed Oct. 2, 2018.
U.S. Appl. No. 16/149,940 Arnone, et al. filed Oct. 2, 2018.
U.S. Appl. No. 16/161,009 Arnone, et al. filed Oct. 15, 2018.
U.S. Appl. No. 16/161,011 Arnone, et al. filed Oct. 15, 2018.
U.S. Appl. No. 16/169,992 Arnone, et al. filed Oct. 24, 2018.
U.S. Appl. No. 16/181,944 Arnone, et al. filed Nov. 6, 2018.
U.S. Appl. No. 16/182,010 Arnone, et al. filed Nov. 6, 2018.
U.S. Appl. No. 16/186,087 Arnone, et al. filed Nov. 9, 2018.
U.S. Appl. No. 15/651,934 Arnone, et al. filed Jul. 17, 2017.
U.S. Appl. No. 15/657,826 Arnone, et al. filed Jul. 24, 2017.
U.S. Appl. No. 15/657,835 Arnone, et al. filed Jul. 24, 2017.
U.S. Appl. No. 15/664,535 Arnone, et al. filed Jul. 31, 2017.
U.S. Appl. No. 15/667,168 Arnone, et al. filed Aug. 2, 2017.
U.S. Appl. No. 15/670,492 Arnone, filed Aug. 7, 2017.
U.S. Appl. No. 15/681,966 Arnone, et al. filed Aug. 21, 2017.
U.S. Appl. No. 15/681,970 Arnone, et al. filed Aug. 21, 2017.
U.S. Appl. No. 15/681,978 Arnone, et al. filed Aug. 21, 2017.
U.S. Appl. No. 15/687,922 Arnone, et al. filed Aug. 28, 2017.
U.S. Appl. No. 15/687,927 Arnone, et al. filed Aug. 28, 2017.
U.S. Appl. No. 15/694,520 Arnone, et al. filed Sep. 1, 2017.
U.S. Appl. No. 15/694,738 Arnone, et al. filed Sep. 1, 2017.
U.S. Appl. No. 15/700,022 Arnone, et al. filed Sep. 8, 2017.
U.S. Appl. No. 15/713,595 Arnone, et al. filed Sep. 22, 2017.
U.S. Appl. No. 15/714,896 Arnone, et al. filed Sep. 25, 2017.
U.S. Appl. No. 15/714,902 Arnone, et al. filed Sep. 25, 2017.
U.S. Appl. No. 15/715,144 Arnone, et al. filed Sep. 25, 2017.
U.S. Appl. No. 15/716,317 Arnone, et al. filed Sep. 26, 2017.
U.S. Appl. No. 15/716,318 Arnone, et al. filed Sep. 26, 2017.
U.S. Appl. No. 15/728,096 Arnone, et al. filed Oct. 9, 2017.
U.S. Appl. No. 15/784,961 Arnone, et al. filed Oct. 16, 2017.
U.S. Appl. No. 15/790,482 Arnone, et al. filed Oct. 23, 2017.
U.S. Appl. No. 15/794,712 Arnone, et al. filed Oct. 26, 2017.
U.S. Appl. No. 15/797,571 Arnone, et al. filed Oct. 30, 2017.
U.S. Appl. No. 15/804,413 Arnone, et al. filed Nov. 6, 2017.
U.S. Appl. No. 15/811,412 Arnone, et al. filed Nov. 13, 2017.
U.S. Appl. No. 15/811,419 Arnone, et al. filed Nov. 13, 2017.
U.S. Appl. No. 15/815,629 Arnone, et al. filed Nov. 16, 2017.
U.S. Appl. No. 15/822,908 Arnone, et al. filed Nov. 27, 2017.
U.S. Appl. No. 15/822,912 Arnone, et al. filed Nov. 27, 2017.
U.S. Appl. No. 15/830,614 Arnone, et al. filed Dec. 4, 2017.
U.S. Appl. No. 15/834,006 Arnone, et al. filed Dec. 6, 2017.
U.S. Appl. No. 15/837,795 Arnone, et al. filed Dec. 11, 2017.
U.S. Appl. No. 15/845,433 Arnone, et al. filed Dec. 18, 2017.
U.S. Appl. No. 15/858,817 Arnone, et al. filed Dec. 29, 2017.
U.S. Appl. No. 15/858,826 Arnone, et al. filed Dec. 29, 2017.
U.S. Appl. No. 15/862,329 Arnone, et al. filed Jan. 4, 2018.
U.S. Appl. No. 15/864,737 Arnone, et al. filed Jan. 8, 2018.
U.S. Appl. No. 15/882,328 Arnone, et al. filed Jan. 29, 2018.
U.S. Appl. No. 15/882,333 Arnone, et al. filed Jan. 29, 2018.
U.S. Appl. No. 15/882,428 Arnone, et al. filed Jan. 29, 2018.
U.S. Appl. No. 15/882,447 Arnone, et al. filed Jan. 29, 2018.
U.S. Appl. No. 15/882,850 Arnone, et al. filed Jan. 29, 2018.
U.S. Appl. No. 15/882,902 Arnone, et al. filed Jan. 29, 2018.
U.S. Appl. No. 15/888,512 Arnone, et al. filed Feb. 5, 2018.
U.S. Appl. No. 15/894,398 Arnone, et al. filed Feb. 12, 2018.
U.S. Appl. No. 15/912,019 Arnone, et al. filed Mar. 5, 2018.
U.S. Appl. No. 15/912,026 Arnone, et al. filed Mar. 5, 2018.
U.S. Appl. No. 15/912,529 Arnone, et al. filed Mar. 5, 2018.

HEAD TO HEAD SYSTEMS

CROSS REFERENCE TO RELATED APPLICATIONS

This application is a continuation of U.S. patent application Ser. No. 15/450,287, filed Mar. 6, 2017, now U.S. Pat. No. 10,147,277 issued Dec. 4, 2018, which is a continuation of U.S. patent application Ser. No. 14/727,726, filed Jun. 1, 2015, now U.S. Pat. No. 9,589,421 issued Mar. 7, 2017, which is a continuation of U.S. patent application Ser. No. 14/104,897, filed Dec. 12, 2013, now U.S. Pat. No. 9,047,735 issued Jun. 2, 2015, which is a continuation of Patent Cooperation Treaty Application No. PCT/US13/20479, filed on Jan. 7, 2013, which claims the benefit of U.S. Provisional Patent Application No. 61/631,524 filed on Jan. 5, 2012, and is related to Patent Cooperation Treaty Application No. PCT/US11/26768, filed Mar. 1, 2011, Patent Cooperation Treaty Application No. PCT/US11/63587, filed on Dec. 6, 2011, and Patent Cooperation Treaty Application No. PCT/US12/58156, filed on Sep. 29, 2012, the contents of each of which are hereby incorporated by reference in its entirety as if stated in full herein.

FIELD OF THE INVENTION

Embodiments of the present invention are generally related to gaming and more specifically to a head to head gambling hybrid game that includes both an entertainment game and a gambling game capable of coordinating head to head gambling games that are based upon the entertainment game gameplay sessions of multiple players.

BACKGROUND

The gaming machine manufacturing industry has traditionally developed gaming machines with a gambling game. A gambling game is typically a game of chance, which is a game where the outcome of the game is generally dependent solely on chance (such as a slot machine). A game of chance can be contrasted with a game of skill where the outcome of the game may depend upon a player's skill with the game. Gambling games are typically not as interactive and do not include graphics as sophisticated as an entertainment game, which is a game of skill such as a video game.

SUMMARY OF THE INVENTION

Systems in accordance with embodiments of the invention operate an electromechanical gaming machine. One embodiment includes a real world controller connected to a game world controller, wherein the real world controller is constructed to: accept from the game world controller, a trigger to run a gambling game; and distribute to the game world controller, in response to the trigger, a randomly generated payout of real world credits from a wager in the gambling game; and the game world controller connected to the real world controller and connected by a network to an entertainment software controller executing a multiplayer entertainment game, wherein the game world controller is constructed to: receive from the entertainment software controller via the network, a plurality of players' actions taken during the plurality of players' execution of the multiplayer entertainment game; and trigger the wager in the gambling game based on the players' actions taken during the plurality of players' execution of the multiplayer entertainment game, wherein the game world controller utilizes a gambling controller constructed to: enter the plurality of players into a multiplayer simultaneous gambling session; parameterize wager terms of the wager made in the gambling game based on information associated with each of the plurality of players entered into the multiplayer simultaneous gambling session; trigger the wager in the gambling game during the multiplayer simultaneous gambling session based on the plurality of players' actions; distribute the randomly generated payout of real world credits as a result of the wager in the gambling game during the multiplayer simultaneous gambling session between the plurality of players of the multiplayer entertainment game entered into the multiplayer simultaneous gambling session; determine a payout of resources utilized by the plurality of players in the multiplayer entertainment game gameplay session based on the result of the wager; and distribute to the entertainment software controller via the network, the payout of resources for utilization by the plurality of players in the entertainment game during the multiplayer entertainment game gameplay session.

In a further embodiment, the wager terms further include odds of return for wagers in a pay table.

In another embodiment, the information related to gameplay within the multiplayer entertainment game gameplay session is a multiplayer entertainment game variable set, which includes aspects of the multiplayer entertainment game that can vary during gameplay progression.

In a still further embodiment, the multiplayer entertainment game variable set includes game world credits earned by the plurality of players entered into the multiplayer simultaneous gambling session.

In still another embodiment, the multiplayer entertainment game variable set includes at least one variable selected from the group consisting of enabling elements that are limited resources whose consumption enables the plurality of player's play of the multiplayer entertainment game, actionable elements that trigger the wager in the gambling game when acted upon, required objects in the multiplayer entertainment game necessary for an actionable element to be acted upon, required environmental conditions that are a game state necessary within the multiplayer entertainment game for an actionable element to be acted upon and controlled entity characteristics for a status necessary for a controlled entity associated with a player for an actionable element to be acted upon.

In a yet further embodiment, the head to head gambling controller is further constructed to conduct the multiplayer simultaneous gambling session for the plurality of players after testing the hybrid game for criteria that dictate whether the multiplayer simultaneous gambling session is enabled.

In yet another embodiment, a player of the plurality of players of the hybrid game is an electronic representation of interactions associated with a player profile of the hybrid game.

In a further embodiment, the head to head gambling controller is further constructed to execute on the game world controller.

In another embodiment, the head to head gambling controller is further constructed to execute on a head to head gambling server and communicate with the game world controller via the network.

In a further additional embodiment, the real world controller and the game world controller are constructed using a same processing apparatus.

In a further embodiment, the real world controller and the game world controller are constructed using separate processing apparatuses, and wherein the real world controller and the game world controller are connected by the network.

An embodiment includes an entertainment software controller connected to a game world controller, wherein the entertainment software controller is constructed to: execute a multiplayer entertainment game, the multiplayer entertainment game providing outcomes based upon a plurality of players' actions taken by the plurality of players' as the plurality of players compete against each other during execution of the multiplayer entertainment game to earn a payout of game world credits separately for each player of the plurality of players; and convey to the game world controller, the plurality of players' actions; and the game world controller connected to a real world controller by a network and connected to the entertainment software controller, wherein the game world controller is constructed to: receive from the entertainment software controller, the plurality of players' actions taken during the plurality of players' execution of the multiplayer entertainment game; and trigger the wager in the gambling game based on the players' actions taken during the plurality of players' execution of the multiplayer entertainment game, wherein the game world controller utilizes a gambling controller constructed to: enter the plurality of players into a multiplayer simultaneous gambling session; parameterize wager terms of the wager made in the gambling game based on information associated with each of the plurality of players entered into the multiplayer simultaneous gambling session; trigger the wager in the gambling game via the network during the multiplayer simultaneous gambling session; distribute a randomly generated payout of real world credits as a result of the wager in the gambling game during the multiplayer simultaneous gambling session between the plurality of players of the multiplayer entertainment game entered into the multiplayer simultaneous gambling session; determine a payout of resources utilized by the plurality of players in the multiplayer entertainment game gameplay session based on the result of the wager; and distribute the payout of resources for utilization by the plurality of players in the entertainment game during the multiplayer entertainment game gameplay session.

An embodiment includes a game world controller connected to a real world controller by a network and connected to an entertainment software controller, wherein the game world controller is constructed to: receive from the entertainment software controller, a plurality of players' actions taken during the plurality of players' execution of the multiplayer entertainment game; and trigger the wager in the gambling game based on the players' actions taken during the plurality of players' execution of the multiplayer entertainment game, wherein the game world controller utilizes a gambling controller constructed to: enter the plurality of players into a multiplayer simultaneous gambling session; parameterize wager terms of the wager made in the gambling game based on information associated with each of the plurality of players entered into the multiplayer simultaneous gambling session; trigger the wager in the gambling game via the network during the multiplayer simultaneous gambling session; distribute a randomly generated payout of real world credits as a result of the wager in the gambling game during the multiplayer simultaneous gambling session between the plurality of players of the multiplayer entertainment game entered into the multiplayer simultaneous gambling session; determine a payout of resources utilized by the plurality of players in the multiplayer entertainment game gameplay session based on the result of the wager; and distribute the payout of resources for utilization by the plurality of players in the entertainment game during the multiplayer entertainment game gameplay session.

DETAILED DESCRIPTION

Figure 1:
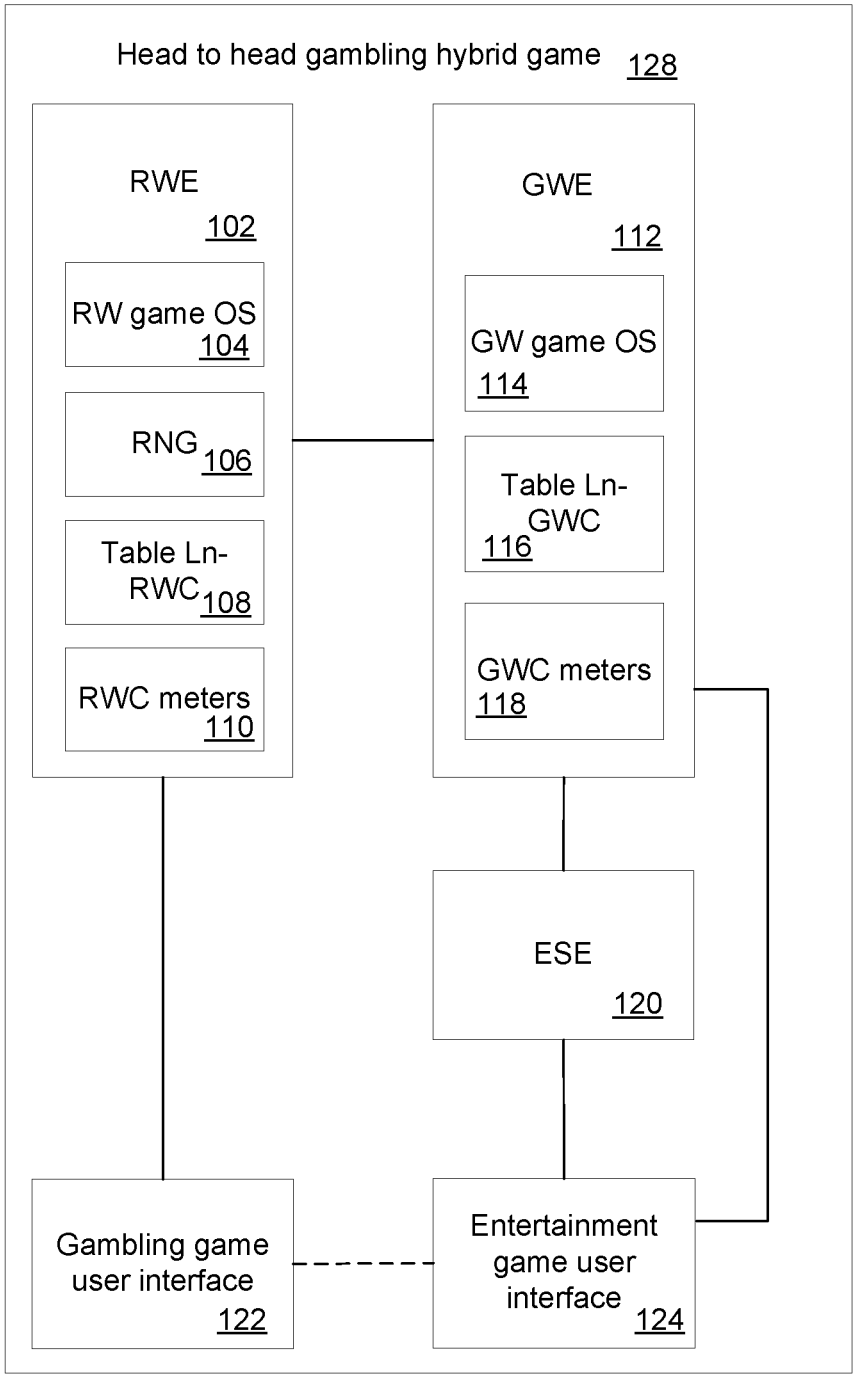
FIG. 1 illustrates a head to head gambling hybrid game in accordance with an embodiment of the invention.

Turning now to the drawings, systems and methods for operation of a head to head gambling hybrid game are illustrated. In several embodiments, a head to head gambling hybrid game is a form of a hybrid game that integrates a head to head gambling controller with both a gambling game that includes a real world engine (RWE) which manages the gambling game, as well as an entertainment game that includes a game world engine (GWE) which manages the entertainment portion of a game, and an entertainment software engine (ESE) which executes the entertainment game for user entertainment. In certain embodiments, the head to head gambling hybrid game also includes a user interface associated with either or both the gambling game and the entertainment game. A player of a head to head gambling hybrid game is the electronic representation of interactions, typically via a user interface, associated with a player profile of the head to head gambling hybrid game. In operation of a head to head gambling hybrid game, a player acts upon various types of elements of the entertainment game in a game world environment. Upon acting on some of these elements, a wager is triggered in the gambling game. In playing the entertainment game, using the elements, a player can consume and accrue game world credits (GWC) within the entertainment game. These credits can be in the form of (but are not limited to) game world objects, experience points, or points generally. Wagers are made in the gambling game using real world credits (RWC). The real world credits can be credits in an actual currency, or may be credits in a virtual currency which has real world value. Gambling outcomes from the gambling game may cause consumption, loss or accrual of RWC. In addition, gambling outcomes in the gambling game may influence elements in the entertainment game such as (but not limited to) by restoring a consumed element, causing the loss of an element, restoration or placement of a fixed element. Example elements include enabling elements (EE) which are elements that enable a player's play of the entertainment game and whose consumption by the player while playing the entertainment game may trigger a wager in a gambling game. In addition, EE may also be replenished during play within the entertainment game based on an outcome of a triggered wager. Other types of elements include actionable elements (AE) which are elements that are acted upon to trigger a wager in the gambling game and may not be restorable during normal play of the entertainment game. In progressing through entertainment game gameplay, a player can utilize a controlled entity (CE) which is a character, entity, inanimate object, device or other object under control of a player. Also, entertainment game gameplay progress can be dependent upon: a required object (RO) which is a specific object in an entertainment game necessary for an AE to be completed (such as but not limited to a specific key needed to open a door); a required environmental condition (REC) which is a game state necessary within an entertainment game for an AE to be completed (such as but not limited to daylight that is required to walk through woods); or a controlled entity characteristic (CEC) which is a status necessary of the CE within an entertainment game for an AE to be completed (such as but not limited to a CE required to have full health points before entering battle). Various hybrid games are discussed in Patent Cooperation Treaty Application No. PCT/US11/26768, filed Mar. 1, 2011, entitled ENRICHED GAME PLAY ENVIRONMENT (SINGLE and/or MULTIPLAYER) FOR CASINO APPLICATIONS and Patent Cooperation Treaty Application No. PCT/US11/63587, filed Dec. 6, 2011, entitled ENHANCED SLOT-MACHINE FOR CASINO APPLICATIONS each disclosure of which is hereby incorporated by reference in its entirety.

In many embodiments, a head to head gambling hybrid game is a hybrid game with a head to head gambling controller that parameterizes a session of head to head gambling in accordance with entertainment game gameplay information. Head to head gambling is a multiplayer gambling session executed by the RWE where at least two players of a multiplayer entertainment game conduct at least one wager in at least one gambling game in which real world credit won as a result of the at least one wager in at least one gambling game is distributed between at least two players of the multiplayer entertainment game.

In numerous embodiments, a head to head gambling controller of a head to head gambling hybrid game parameterizes wager terms of at least one wager conducted in at least one gambling game between at least two players of the multiplayer entertainment game during the head to head gambling session using information related to gameplay within the entertainment game. The information related to gameplay within the entertainment game can include (but is not limited to) an entertainment game's variable set which are variables related to an entertainment game (such as but not limited to RWC, GWC, EE, AE, ROs, RECs, and CECs) or a manual operation by a player (such as but not limited to a player manually electing to enter a head to head gambling session).

In several embodiments, a head to head gambling controller of a head to head gambling hybrid game initiates a head to head gambling session by detecting the occurrence of a latch event in an entertainment game. A latch event is at least one player action from at least one player responsive to gameplay within an entertainment game gameplay session that affects at least two players by causing each player to enter into the same head to head gambling session. A player action can be any type of action within a head to head gambling hybrid game ascribed within entertainment game gameplay to a player, such as a human player associated with a human player profile, from a user interface or a computer player generated automatically from information in a computer player profile stored within the head to head gambling hybrid game. A player action can be an action in gameplay performed by a player (such as but not limited to a player entering a tavern) or an action in gameplay not performed by the player that still affects the player (such as but not limited to a player receiving a kill shot from another player in a shooting type of entertainment game). A latch event can be defined by an operator of a head to head gambling entertainment game (such as but not limited to a casino that hosts the head to head gambling hybrid game) or by players of a head to head entertainment game.

In a number of embodiments, a head to head gambling controller can determine whether head to head gambling is either enabled or disabled by testing the head to head gambling hybrid game for criteria set by an operator of a head to head gambling entertainment game or players of a head to head entertainment game. In certain embodiments, the enablement of head to head gambling dictates whether the head to head gambling controller can detect a latch event.

In numerous embodiments, a head to head gambling controller can be implemented locally on a head to head gambling hybrid game within the GWE to parameterize a head to head gambling session executed by the RWE, remotely on a head to head gambling server accessible to a head to head gambling hybrid game via a network or as a distributed system where processes of a head to head gambling controller occur locally on a head to head gambling hybrid game and on a remote server.

In several embodiments, a head to head gambling controller can access a database containing various player profiles, an entertainment game's variable set, rules that govern the parameterization of a gambling game, definitions of a latch event and/or criteria utilized to test for enablement or disablement of head to head gambling. A head to head gambling controller can utilize the database to store and retrieve information related to players and/or gameplay within a head to head gambling hybrid game. In certain embodiments, the GWE can track the players engaged in gameplay with the head to head gambling controller managing the parameterization of a head to head gambling game with information related to gameplay within the entertainment game, such as but not limited to an entertainment game's variable set provided to the head to head gambling controller by the GWE.

Head to head gambling hybrid games in accordance with embodiments of the invention are discussed below.

Head to Head Gambling Hybrid Games

In many embodiments, a head to head gambling hybrid game integrates high levels of entertainment content with a game of skill (entertainment game), a gambling experience with a game of chance (gambling game). A head to head gambling hybrid game provides for random outcomes independent of player skill while providing that the user's gaming experience (as measured by obstacles/challenges encountered, time of play and other factors) is shaped by the player's skill. The head to head gambling hybrid game can also utilize a head to head gambling controller to parameterize a head to head gambling session of at least one gambling game based upon information related to entertainment game gameplay. A head to head gambling hybrid game in accordance with an embodiment of the invention is illustrated in FIG. 1. The head to head gambling hybrid game 128 includes a RWE 102, GWE 112, ESE 120, gambling game user interface 122 and entertainment game user interface 124. The two user interfaces may be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124.

In several embodiments, the RWE 102 is the operating system for the gambling game of the skill calibrated hybrid game 128 and controls and operates the gambling game. The operation of a gambling game is enabled by RWC, such as money or other real world funds. A gambling game can increase or decreases an amount of RWC based on random gambling outcomes, where the gambling proposition of a gambling game is typically regulated by gaming control bodies. In many embodiments, the RWE includes a RW operating system (OS) 104, random number generator (RNG) 106, level n real-world credit pay tables (Table Ln-RWC) 108, RWC meters 110 and other software constructs that enable a game of chance to offer a fair and transparent gambling proposition, and to contain the auditable systems and functions that can enable the game to obtain gaming regulatory body approval.

A random number generator (RNG) 106 includes software and/or hardware algorithms and/or processes, which are used to generate random outcomes. A level n real-world credit pay table (Table Ln-RWC) 108 is a table that can be used in conjunction with a random number generator (RNG) 106 to dictate the real world credits (RWC) earned as a function of sponsored gameplay and is analogous to the pay tables used in a conventional slot machine. Table Ln-RWC payouts are independent of player skill. There may be one or a plurality of Table Ln-RWC pay tables 108 contained in a gambling game, the selection of which may be determined by factors including (but not limited to) game progress a player has earned, and/or bonus rounds which a player may be eligible for. Real world credits (RWC) are credits analogous to slot machine game credits, which are entered into a gambling game by the user, either in the form of money such as hard currency or electronic funds. RWCs can be decremented or augmented based on the outcome of a random number generator according to the Table Ln-RWC real world credits pay table 108, independent of player skill. In certain embodiments, an amount of RWC can be required to enter higher ESE game levels. RWC can be carried forward to higher game levels or paid out if a cash out is opted for by a player. The amount of RWC required to enter a specific level of the game level n need not be the same for each level.

In many embodiments, the GWE 112 manages the overall head to head gambling hybrid game operation, with the RWE 102 and the ESE 120 effectively being support units to the GWE 112. In several embodiments, the GWE 112 contains mechanical, electronic and software system for an entertainment game. The GWE 112 includes a GW game operating system (OS) 114 that provides control of the entertainment game. The GWE additionally contains a level n game world credit pay table (Table Ln-GWC) 116 from where to take input from this table to affect the play of the entertainment game. The GWE 112 can further couple to the RWE 102 to determine the amount of RWC available on the game and other metrics of wagering on the gambling game (and potentially affect the amount of RWC in play on the RWE). The GWE additionally contains various audit logs and activity meters (such as the GWC meter) 118. The GWE 112 can also couple to a centralized server for exchanging various data related to the player and their activities on the game. The GWE 112 furthermore couples to the ESE 120.

In many embodiments, a level n game world credit pay table (Table Ln-GWC) 116 dictates the GWC earned as a function of player skill in the nth level of the game. The payouts governed by this table are dependent upon player skill and sponsored gameplay at large and may or may not be coupled to a random number generator. In several embodiments, game world credits (GWC) are player points earned or depleted as a function of player skill, specifically as a function of player performance in the context of the game. GWC is analogous to the score in a typical video game. Each entertainment game has one or more scoring criterion, embedded within the Table Ln-GWC 116 that reflects player performance against the goal(s) of the game. GWC can be carried forward from one level of sponsored gameplay to another, and ultimately paid out in various manners such as directly in cash, or indirectly such as earning entrance into a sweepstakes drawing, or earning participation in, or victory in, a tournament with prizes. GWC may be stored on a player tracking card or in a network-based player tracking system, where the GWC is attributed to a specific player.

In certain embodiments, the operation of the GWE does not affect the RWE's gambling operation except for player choice parameters that are allowable in slot machines today including but not limited to the wager amount, how fast the player wants to play (by pressing a button or pulling the slot's handle) and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RWC available in the gambling game. The communication link can also convey a necessary status operation of the RWE (such as on-line or tilt). The communication link can further communicate the various gambling control factors which the RWE 102 uses as input, such as the number of RWC consumed per game or the player's election to enter a jackpot round. In FIG. 1, the GWE 112 is also shown as connecting to the player's user interface directly, as this may be necessary to communicate certain entertainment game club points, player status, control the selection of choices and messages which a player may find useful in order to adjust their entertainment game experience or understand their gambling status in the RWE 102.

In various embodiments, the ESE 120 manages and controls the visual, audio, and player control for the entertainment game. In certain embodiments, the ESE 120 accepts input from a player through a set of hand controls, and/or head, gesture, and/or eye tracking systems and outputs video, audio and/or other sensory output to a user interface. In many embodiments, the ESE 120 can exchange data with and accept control information from the GWE 112. In several embodiments an ESE 120 can be implemented using a personal computer (PC), a Sony PlayStation® (a video game console developed by Sony Computer Entertainment of Tokyo Japan), or a Microsoft Xbox® (a video game console developed by Microsoft Corporation of Redmond, Wash.) running a specific entertainment game software program. In numerous embodiments, an ESE can be an electromechanical game system of a head to head gambling hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 may send certain GW game control parameters and elements to the ESE 120 to affect its play, such as (but not limited to) what level of character to be using, changing the difficulty level of the game, changing the type of gun or car in use, and/or requesting potions to become available or to be found by the character. These game control parameters and elements may be based on a gambling outcome of a gambling game that was triggered by an element in the entertainment game being acted upon by the player. The ESE 120 can accept this input from the GWE 112, make adjustments, and continue the play action all the while running seamlessly from the player's perspective. The ESE's operation is mostly skill based, except for where the ESE's processes may inject complexities into the game by chance in its normal operation to create unpredictability in the entertainment game. Utilizing this interface, the ESE 120 may also communicate player choices made in the game to the GWE 112, such as but not limited to selection of a different gun, and/or the player picking up a special potion in the GW environment. The GWE's job in this architecture, being interfaced thusly to the ESE 120, is to allow the transparent coupling of entertainment software to a fair and transparent random chance gambling game, providing a seamless perspective to the player that they are playing a typical popular entertainment game (which is skill based). In certain embodiments, the ESE 120 can be used to enable a wide range of entertainment games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In several embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RWC in play, and amount of RWC available. The RWE 102 can accept modifications in the amount of RWC wagered on each individual gambling try, or the number of games per minute the RWE 102 can execute, entrance into a bonus round, and other factors, all the while these factors can take a different form than that of a typical slot machine. An example of a varying wager amount that the player can choose might be that they have decided to play with a more powerful character in the game, a more powerful gun, or a better car. These choices can increase or decrease the amount wagered per individual gambling game, in the same manner that a standard slot machine player may decide to wager more or less credits for each pull of the handle. In several embodiments, the RWE 102 can communicate a number of factors back and forth to the GWE 112, via an interface, such increase/decrease in wager being a function of the player's decision making as to their operational profile in the entertainment game (such as but not limited to the power of the character, gun selection or car choice). In this manner, the player is always in control of the per game wager amount, with the choice mapping to some parameter or component that is applicable to the entertainment game experience of the hybrid game. In a particular embodiment, the RWE 102 operation can be a game of chance as a gambling game running every 10 seconds where the amount wagered is communicated from the GWE 112 as a function of choices the player makes in the operation profile in the entertainment game such as those cited above.

In many embodiments, a head to head gambling hybrid game integrates a video game style gambling machine, where the gambling game (including an RWE 102 and RWC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time a rich environment of rewards to stimulate gamers can be established with the entertainment game. In several embodiments, the head to head gambling hybrid game can leverage very popular titles with gamers and provides a sea change environment for casinos to attract players with games that are more akin to the type of entertainment that a younger generation desires. In various embodiments, players can use their skill towards building and banking GWC that in turn can be used to win tournaments and various prizes as a function of their gamer prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In certain embodiments, head to head gambling hybrid games also allow players to gain entry into subsequent competitions through the accumulation of game world credits (GWC) that accrue as a function of the user's demonstrated skill at the game. These competitions can pit individual players or groups of players against one another and/or against the casino to win prizes based upon a combination of chance and skill. These competitions may be either asynchronous events, whereby players participate at a time and/or place of their choosing, or they may be synchronized events, whereby players participate at a specific time and/or venue.

In many embodiments, one or more players engage in playing an entertainment game, resident in the ESE, the outcomes of which are dependent at least in part on skill. The head to head gambling hybrid game can include an entertainment game that includes head to head play between a single player and the computer, between two or more players against one another, or multiple players playing against the computer and/or each other, as well as the process by which players bet on the outcome of the entertainment game. The entertainment game can also be a game where the player is not playing against the computer or any other player, such as in games where the player is effectively playing against himself or herself (such as but not limited to Solitaire and Babette).

In many embodiments, if an entertainment game includes a version of Madden Football™ a player can bet on whether or not the player is going to beat the computer, or if the player is playing against another player, that other player. These bets can be made, for example, on the final outcome of the game, and/or the state of the game along various intermediary points (such as but not limited to the score at the end of the 1st quarter) and/or on various measures associated with the game (such as but not limited to the total offensive yards, number of turnovers, or number of sacks). Players can bet against one another, or engage the computer in a head to head competition in the context of their skill level in the entertainment game in question. As such, players can have a handicap associated with their player profile that describes their skill (which can be their professed skill in certain embodiments), and which is used by a GWE (such as a local GWE or a GWE that receives services from remote servers) to offer appropriate bets around the final and/or intermediate outcomes of the entertainment game, and/or to condition sponsored gameplay as a function of player skill, and/or to select players across one or more head to head gambling hybrid games to participate in head to head games and/or tournaments.

Many embodiments enable the maximization of the number of players able to compete competitively by utilizing a skill normalization controller. Handicapping enables players of varying performance potential to compete competitively regardless of absolute skill level, such as but not limited to where a player whose skill level identifies the player as a beginner can compete in head to head or tournament play against a highly skilled player with meaningful results.

In several embodiments, wagers can be made among numerous head to head gambling hybrid games with a global betting manager (GBM). The GBM is a system that coordinates wagers that are made across multiple head to head gambling hybrid games by multiple players. In some implementations it can also support wagers by third parties relative to the in game performance of other players. The GBM can stand alone, or is capable of being embedded in one of a number of systems, including a GWE, ESE or any remote server capable of providing services to a head to head gambling hybrid game, or can operate independently on one or a number of servers on-site at a casino, as part of a larger network and/or the internet or cloud in general. The GBM also supports the management of lottery tickets issued as a function of sponsored gameplay.

Although various components of head to head gambling hybrid games are discussed above, head to head gambling hybrid games can be configured with any component as appropriate to the requirements of a specific application in accordance with embodiments of the invention. Network connected head to head gambling hybrid games are discussed below.

Network Connected Head to Head Gambling Hybrid Games

Head to head gambling hybrid games in accordance with many embodiments of the invention can operate locally while being network connected to draw services from remote locations or to communicate with other head to head gambling hybrid games. In many embodiments, operations associated with a head to head gambling hybrid game such as (but not limited to) processes for calculating score or RWC and GWC tracking can be performed across multiple devices. These multiple devices can be implemented using a single server or a plurality of servers such that a head to head gambling hybrid game is executed as a system in a virtualized space, such as (but not limited to) where the RWE and GWE are large scale centralized servers in the cloud coupled to a plurality of widely distributed ESE controllers or clients via the Internet.

In many embodiments, an RWE server can perform certain functionalities of a RWE of a head to head gambling hybrid game. In certain embodiments, a RWE server includes a centralized odds engine which can generate random outcomes (such as but not limited to win/loss outcomes) for a gambling game, thereby eliminating the need to have that functionality of the RWE performed locally within the head to head gambling hybrid game. The RWE server can perform a number of simultaneous or pseudo-simultaneous runs in order to generate random outcomes for a variety of odds percentages that one or more networked head to head gambling hybrid games may require. In certain embodiments, an RWE of a head to head gambling hybrid game can send information to a RWE server including (but not limited to) Table Ln-RWC tables, maximum speed of play for a gambling game, gambling game monetary denominations or any promotional RWC provided by the operator of the head to head gambling hybrid game. In particular embodiments, a RWE server can send information to a RWE of a head to head gambling hybrid game including (but not limited to) RWC used in the gambling game, player profile information or play activity and a profile associated with a player.

In several embodiments, a GWE server can perform the functionality of the GWE across various head to head gambling hybrid games. These functionalities can include (but are not limited to) providing a method for monitoring high scores on select groups of games, coordinating interactions between gameplay layers, linking groups of games in order to join them in head to head tournaments, and acting as a tournament manager.

In a variety of embodiments, management of player profile information can be performed by a GWE patron management server separate from a GWE server. A GWE patron management server can manage information related to a player profile, including (but not limited to) data concerning players' characters, players' game scores, players' RWC and GWC and managing tournament reservations. Although a GWE patron management server is discussed separate from a GWE server, in certain embodiments a GWE server also performs the functions of a GWE patron management server. In certain embodiments, a GWE of a head to head gambling hybrid game can send information to a GW patron management server including (but not limited to) GWC and RWC used in a game, player profile information, play activity and profile information for players and synchronization information between a gambling game and an entertainment game or other aspects of a head to head gambling hybrid game. In particular embodiments, a GW patron management server can send information to a GWE of a head to head gambling hybrid game including (but not limited to) entertainment game title and type, tournament information, Table Ln-GWC tables, special offers, character or profile setup and synchronization information between a gambling game and an entertainment game or other aspects of a head to head gambling hybrid game.

In numerous embodiments, an ESE server provides a host for managing head to head play, operating on the network of ESEs which are connected to the ESE server by providing an environment where players can compete directly with one another and interact with other players. Although an ESE server is discussed separate from a GWE server, in certain embodiments a GWE server also performs the functions of an ESE server.

In several embodiments, a head to head gambling server can be connected with a head to head gambling hybrid game and can implement a head to head gambling controller to coordinate the activities of a head to head gambling hybrid game. A head to head gambling controller can execute as part of a head to head gambling server to parameterize a head to head gambling session of at least one gambling game based upon information related to entertainment game gameplay.

Servers connected via a network to implement head to head gambling hybrid games in accordance with many embodiments of the invention can communicate with each other to provide services utilized within a head to head gambling hybrid game. In several embodiments a RWE server can communicate with a GWE server. A RWE server can communicate with a GWE server to communicate any type of information as appropriate for a specific application, including (but not limited to): configure the various simultaneous or pseudo simultaneous odds engines executing in parallel within the RWE to accomplish the head to head gambling hybrid game system requirements, determine metrics of RWE performance such as random executions run and outcomes for tracking system performance, perform audits, provide operator reports, and request the results of a random run win/loss result for use of function operating within the GWE (such as where automatic drawings for prizes are a function of ESE performance).

In several embodiments a GWE server can communicate with an ESE server. A GWE server can communicate with an ESE server to communicate any type of information as appropriate for a specific application, including (but not limited to): the management of an ESE server by a GWE server such as the management of a head to head gambling hybrid game tournament. Typically a GWE (such as a GWE that runs within a head to head gambling hybrid game or on a GWE server) is not aware of the relationship of itself to the rest of a tournament since in a typical configuration the actual tournament play is managed by the ESE server. Therefore, management of a head to head gambling hybrid game tournament can include (but is not limited to) tasks such as: conducting tournaments according to system programming that can be coordinated by an operator of the head to head gambling hybrid game; allowing entry of a particular player into a tournament; communicating the number of players in a tournament and the status of the tournament (such as but not limited to the amount of surviving players, their status within the game, time remaining on the tournament); communicating the status of an ESE contained in a game; communicating the performance of its players within the tournament; communicating the scores of the various members in the tournament; and providing a synchronizing link to connect the GWEs in a tournament, with their respective ESE's.

In several embodiments a GWE server can communicate with a GW patron server. A GWE server can communicate with a GW patron server to communicate any type of information as appropriate for a specific application, including (but not limited to) information for configuring tournaments according to system programming conducted by an operator of a head to head gambling hybrid game, exchange of data necessary to link a player's player profile to their ability to participate in various forms of sponsored gameplay (such as but not limited to the difficulty of play set by the GWE server or the GWE in the game they are playing on), determining a player's ability to participate in a tournament as a function of a player's characteristics (such as but not limited to a player's gaming prowess or other metrics used for tournament screening), configuring the game contained GWE and ESE performance to suit preferences of a player on a particular head to head gambling hybrid game, as recorded in their player profile, determining a player's play and gambling performance for the purposes of marketing intelligence, and logging secondary drawing awards, tournament prizes, RWC and GWC into the player profile.

In many embodiments, the actual location of where various algorithms and functions are executed may be located either in the game contained devices (RWE, GWE, ESE), on the servers (RWE server, GWE server, or ESE server), or a combination of both. In particular embodiments, certain functions of a RWE server, GWE server, GW patron server or ESE server may operate on the local RWE, GWE or ESE contained with a head to head gambling hybrid game locally. In certain embodiments, a server is a server system including a plurality of servers, where software may be run on one or more physical devices. Similarly, in particular embodiments, multiple servers may be combined on a single physical device.

Figure 2:
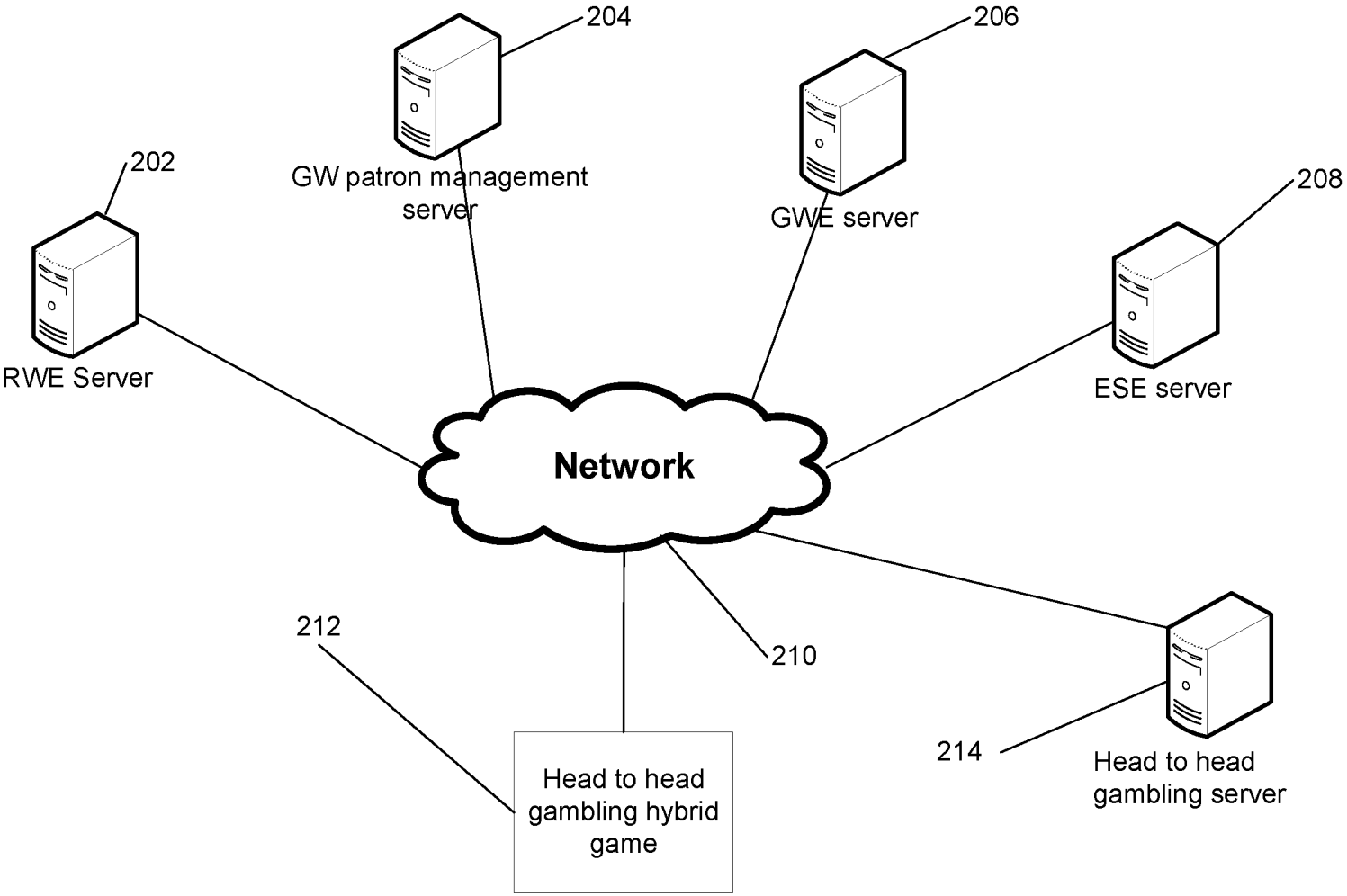
FIG. 2 is a system diagram that illustrates a network distributed head to head gambling hybrid game in accordance with an embodiment of the invention.

Head to head gambling hybrid games in accordance with many embodiments of the invention can be networked with remote servers in various configurations. A networked head to head gambling hybrid game in accordance with an embodiment of the invention is illustrated in FIG. 2. The networked head to head gambling hybrid game 212 is connected with a RWE server 202, GW patron management server 204, GWE server 206, ESE server 208 and a head to head gambling server 214 over a network 210, such as (but not limited to) the Internet. Servers networked with a networked head to head gambling hybrid game 212 can also communicate with each of the components of a networked head to head gambling hybrid game and amongst the other servers in communication with the networked head to head gambling hybrid game 212.

Although various networked head to head gambling hybrid games are discussed above, head to head gambling hybrid games can be networked in any configuration as appropriate to the requirements of a specific application in accordance with embodiments of the invention. Head to head gambling controllers are discussed below.

Head to Head Gambling Controllers

A head to head gambling controller in accordance with many embodiments of the invention enables a multiplayer simultaneous gambling session where the wager terms in at least one gambling game during the gambling session are parameterized in accordance with information related to entertainment game gameplay. This can be contrasted with gameplay where a gambling game is initiated for a single player only and/or that includes wager terms that are set irrespective of information related to entertainment game gameplay. In many embodiments, gambling games can be executed within a head to head gambling hybrid game that can be part of a head to head gambling session. Alternatively, the gambling games can be executed outside of a head to head gambling session.

In several embodiments, each player participating in a head to head gambling hybrid game's entertainment game consumes EE (from an individual or collective store) in an entertainment game, which in turn causes an AE within the entertainment game. Each player participates in the same entertainment game subject to interactivity with each other with the same rules for gameplay progression and utilization of resources offered in the entertainment game.

In a number of embodiments, a head to head gambling controller continuously monitors an entertainment game by testing whether the conditions that enable or disable head to head gambling are present. These tests can take entertainment game gameplay information as arguments, such as an entertainment game variable set. An entertainment game variable set includes any and all variables related to the entertainment game including (but not limited to) players' EE, GWC, game ROs, RECs, and CECs. These variables can also include variables related to a player, as opposed to a player's CE, or operator-specified variables that can affect the outcome of the test as to whether a head to head gambling event can take place.

When conditions that enable head to head gambling are present, the head to head gambling controller can monitor whether a latch event has occurred by which a head to head gambling session can be initialized with wagers parameterized based upon the entertainment game variable set. A latch event is an event in an entertainment game that triggers parameterization of a head to head gameplay session by which each the entertainment game gameplay of each player that is to participate in a head to head gambling session is (sufficiently) synchronized to generate meaningful parameterization of a head to head gambling session. In certain embodiments, a latch event requires that two players enter a particular tavern in an adventure game for both players to enter a head to head gambling session. After a first player enters the tavern, the head to head gambling controller monitors for the entry of a second player, at which time the head to head gambling controller enables the gambling game to be parameterized as a function of entertainment game gameplay information, such as from an entertainment game variable set.

In many embodiments, parameterization of a head to head gambling session includes defining the wager terms of wagers made during gambling games undertaken during the head to head gambling session. These wager terms can be defined from detailing pay tables for wagers and establishing how any gains from a wager are distributed among players involved in a head to head gambling session. Parameterization of a head to head gambling session also defines the functions that determine how much RWC each player contributes to a gambling game in a head to head gambling session. The amount of RWC each player contributes to a gambling game can be of a different amount for each player for any given session of the gambling game. Additionally, parameterization of a head to head gambling session can also define the payouts from each wager in the head to head gambling session. These payouts can be payouts of RWC from the gambling games and/or also as a payout that affects the entertainment game variable set of a player. Furthermore, parameterization of a head to head gambling session can also define how payouts from wagers made in the head to head gambling session are added to a bonus pool.

Figure 3A:
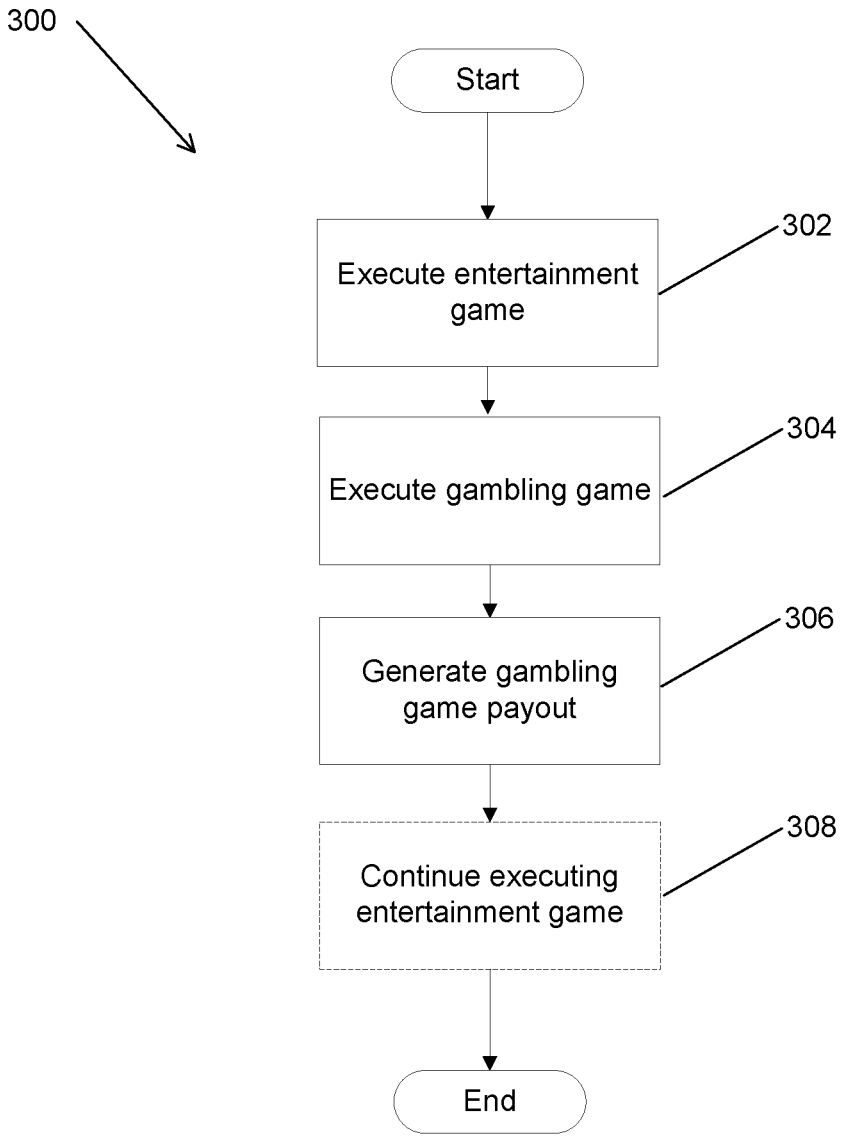
FIG. 3A illustrates a flow chart of a process of gameplay with a gambling game that is not part of a head to head gambling session in accordance with an embodiment of the invention.
Figure 3B:
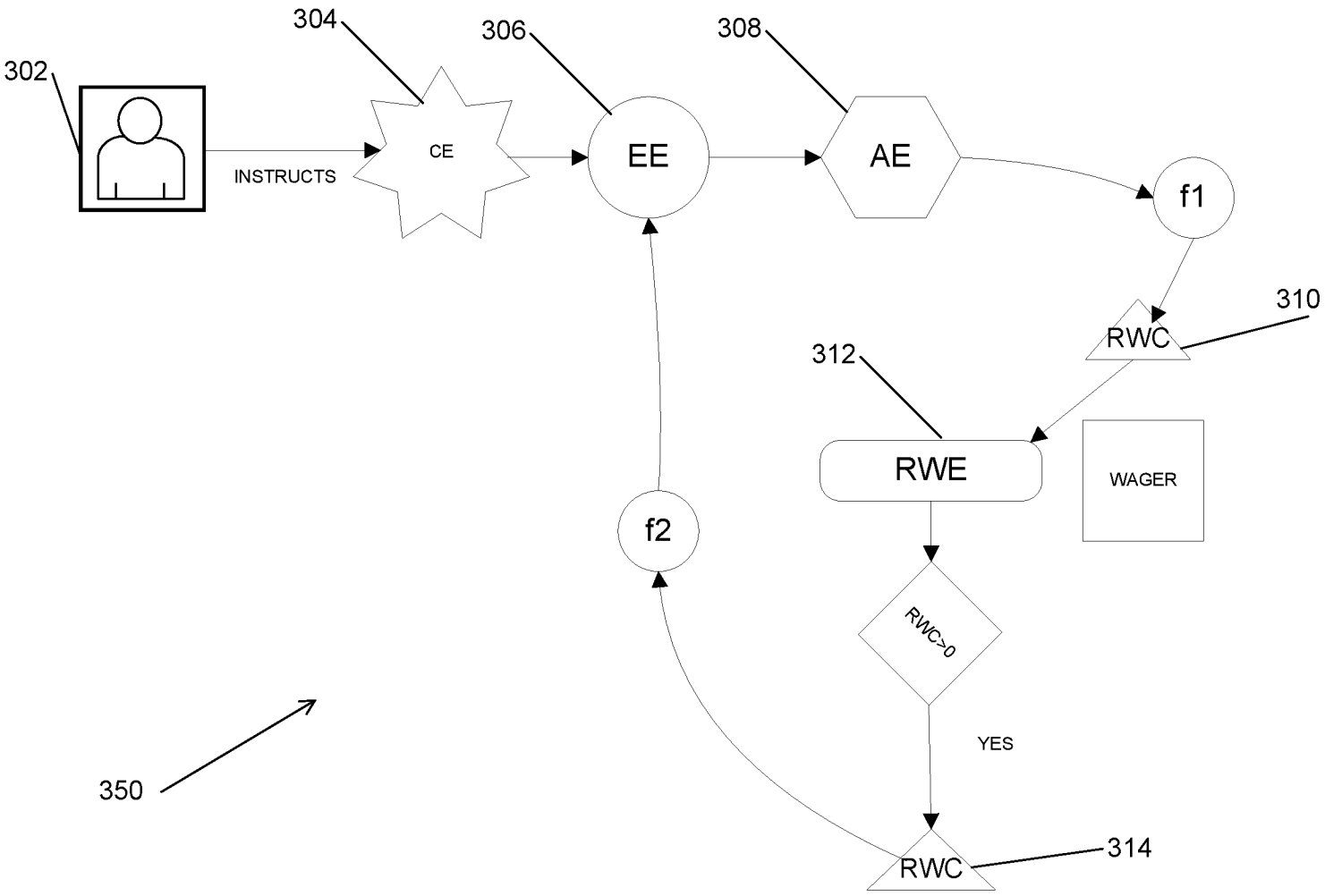
FIG. 3B illustrates a conceptual diagram that illustrates utilization of resources in the process illustrated in FIG. 3A in accordance with an embodiment of the invention.

A flow chart of a process of gameplay with a gambling game that is not part of a head to head gambling session in accordance with an embodiment of the invention is illustrated in FIG. 3A. The process 300 includes executing (302) an entertainment game, which in turn can trigger the execution (304) of a gambling game. The gambling game can generate (306) a payout of RWCs due to a wager made within the gambling game. Optionally, the entertainment game can continue (308) to execute during and/or after the execution of the gambling game and/or the payout from wagers made during the gambling game. A conceptual diagram that illustrates utilization of resources in a process similar to the process illustrated in FIG. 3A in accordance with an embodiment of the invention is illustrated in FIG. 3B. The diagram 350 illustrates that a player 302 can instruct a CE 304 to utilize EE 306 to perform an AE 308 in an entertainment game. The AE 308 can then trigger a gambling game in which RWC 310 is utilized in a RWE 312 within at least one wager. When a gambling game session is completed, a determination is made as to whether there is any RWC 314 left within the gambling game session, which is paid out and/or used to reallocate the EE 306 available to the CE in the entertainment game.

Figure 4:
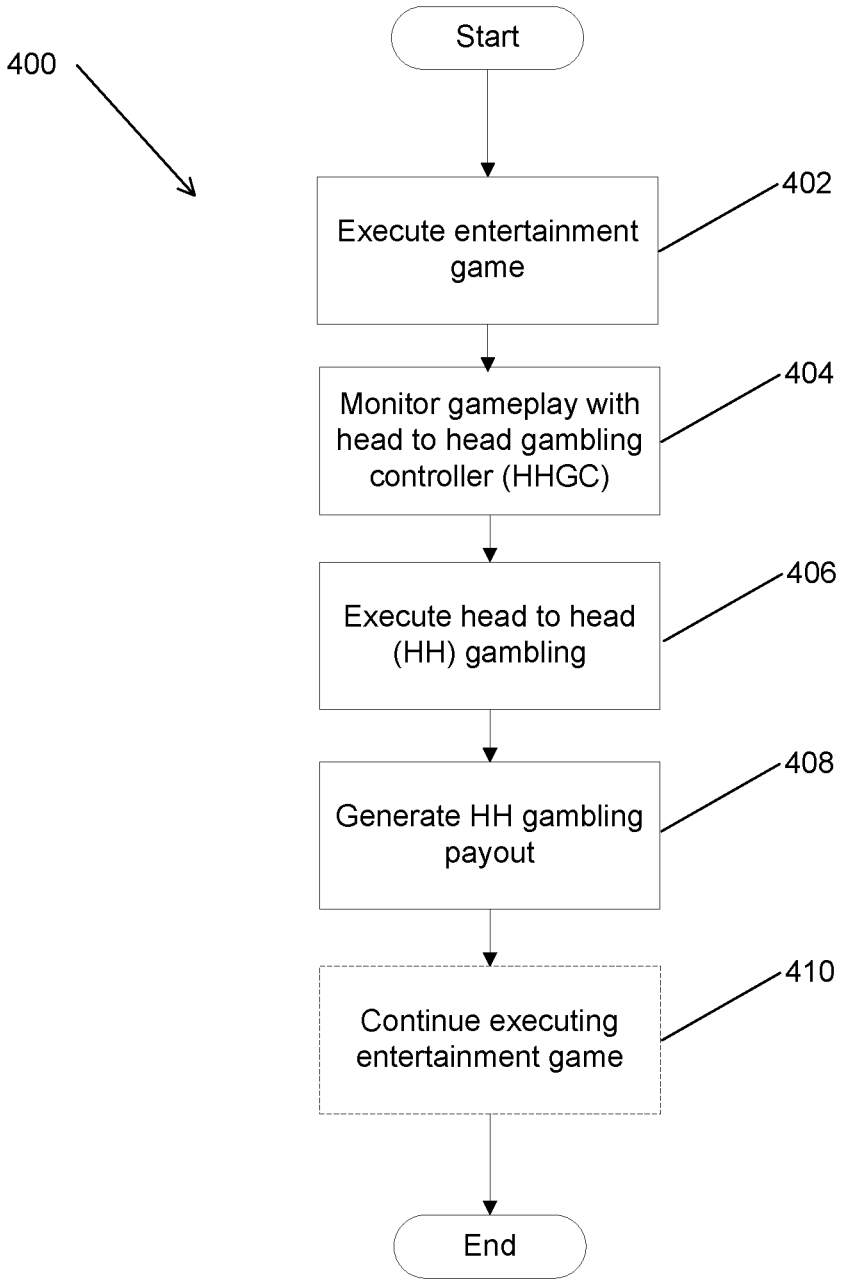
FIG. 4 illustrates a flow chart of a process of head to head gambling hybrid game gameplay with a gambling game that is part of a head to head gambling session in accordance with an embodiment of the invention.

A flow chart of a process of head to head gambling hybrid game gameplay with a gambling game that is part of a head to head gambling session in accordance with an embodiment of the invention is illustrated in FIG. 4. The process 400 includes executing (402) an entertainment game. During the execution of the entertainment game, a head to head gambling controller monitors (404) the entertainment game by testing the entertainment game to determine if head to head gambling should be enabled or disabled. If a head to head gambling session is enabled, then the head to head gambling controller can continue to monitor (404) the entertainment game to determine if a latch event has occurred. When a latch event is detected, then a head to head gambling session that includes multiple players engaged in at least one gambling game can be initiated (406) with wagers parameterized based upon information related to entertainment game gameplay. During and/or after the execution of the head to head gambling session, payouts from wagers made during the head to head gambling session are generated (408). An entertainment game can occur simultaneously and/or continue (410) after a head to head gambling session is initiated.

Figure 5:
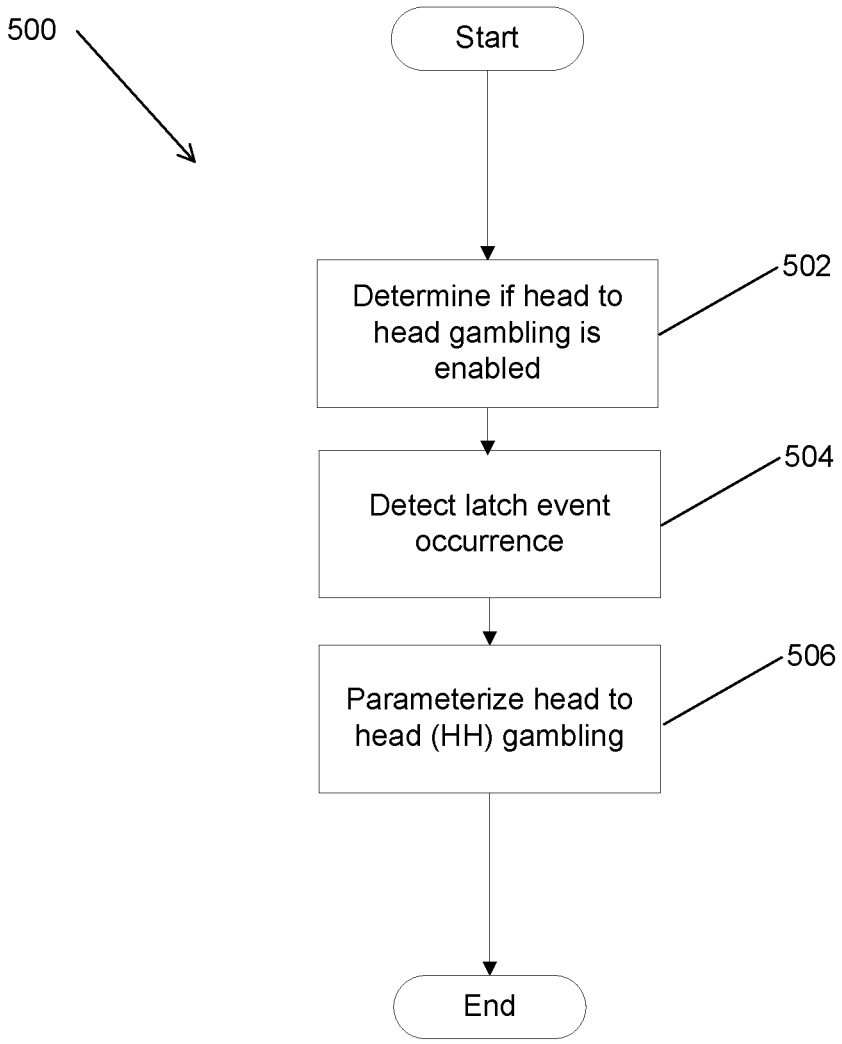
FIG. 5 illustrates a flow chart of a process of parameterizing wager terms of a head to head gambling session using a head to head gambling controller in accordance with an embodiment of the invention.

A flow chart of a process of parameterizing wager terms in a head to head gambling session using a head to head gambling controller in accordance with an embodiment of the invention is illustrated in FIG. 5. The process 500 includes monitoring a head to head gambling hybrid game to determine (502) if head to head gambling is enabled by a head to head gambling controller. In certain embodiments, an operator or players of a head to head gambling hybrid game can enable or disable head to head gambling manually or automatically based upon a testable rule that governs when head to head gambling is enabled or disabled based upon a set of conditions (such as but not limited to when a certain amount of time has elapsed or a certain accumulation of GWC by players). If head to head gambling is enabled, a head to head gambling controller can monitor (504) the gameplay of the head to head gambling hybrid game to detect whether a latch event has occurred. A latch event can include any event that can transpire within an entertainment game which can trigger a head to head gambling session. In certain embodiments, a latch event can include the occurrences of several simultaneous or consecutive events in an entertainment game. A head to head gambling session is initiated and parameterized (506) upon the detection of a latch event.

Figure 6:
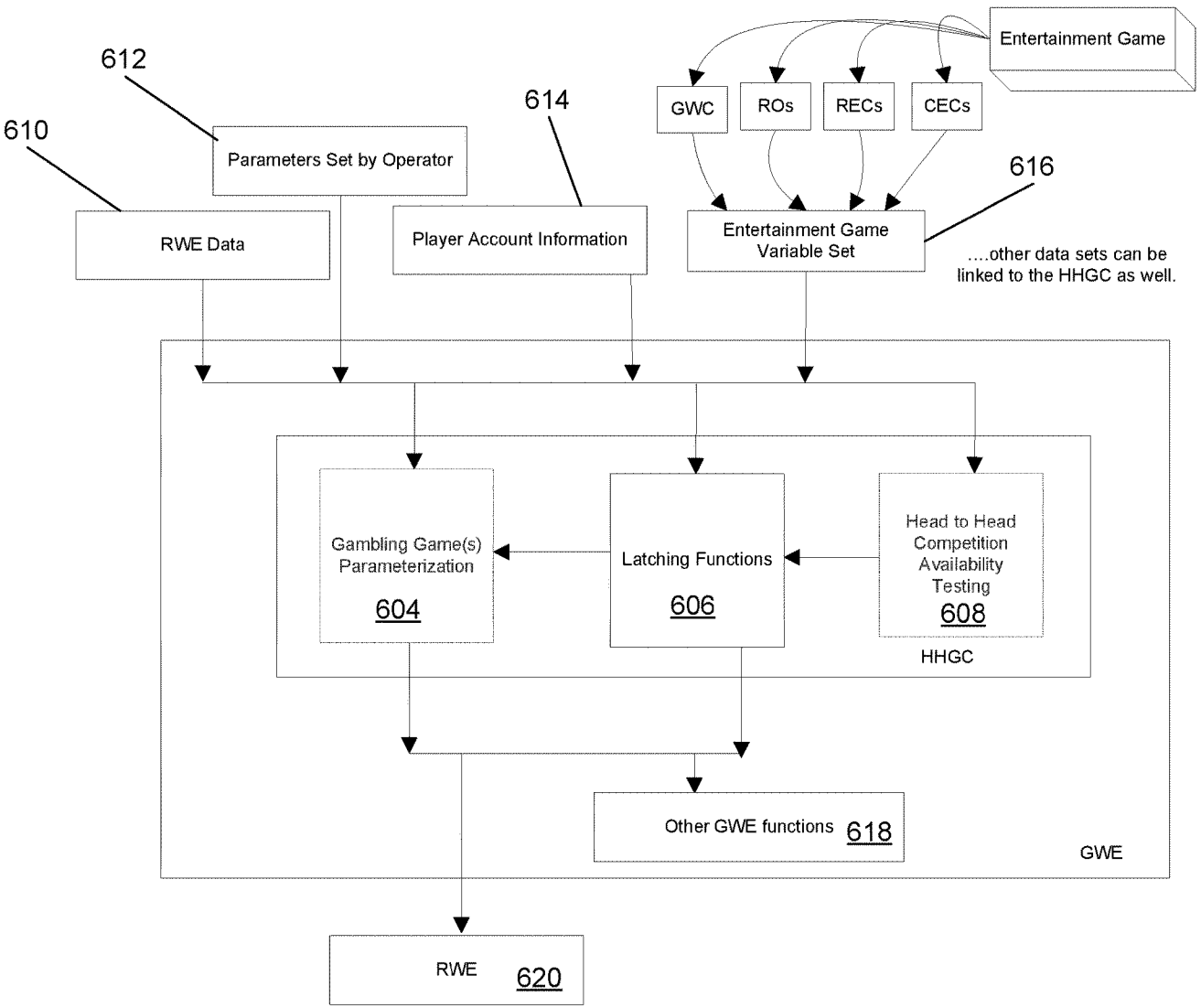
FIG. 6 illustrates a conceptual diagram that illustrates a process of operating a head to head gambling controller in accordance with an embodiment of the invention.

A conceptual diagram that illustrates a process of operating a head to head gambling controller in accordance with an embodiment of the invention is illustrated in FIG. 6. The conceptual diagram includes the various types of information that can be utilized to configure gambling game parameterization 604, latching functions 606 or head to head gambling enablement 608 including (but not limited to) an entertainment game's variable set 616, RWE data 610, parameters that limit the bounds of the head to head gambling hybrid game's operation set by an operator 612 and player account information 614. Within the GWE, the latching functions and the gambling game parameterization can also be utilized to affect the operation of other GWE functions 618 as well as the parameterization of wagers within at least one gambling game executed by a RWE 620.

Figure 7:
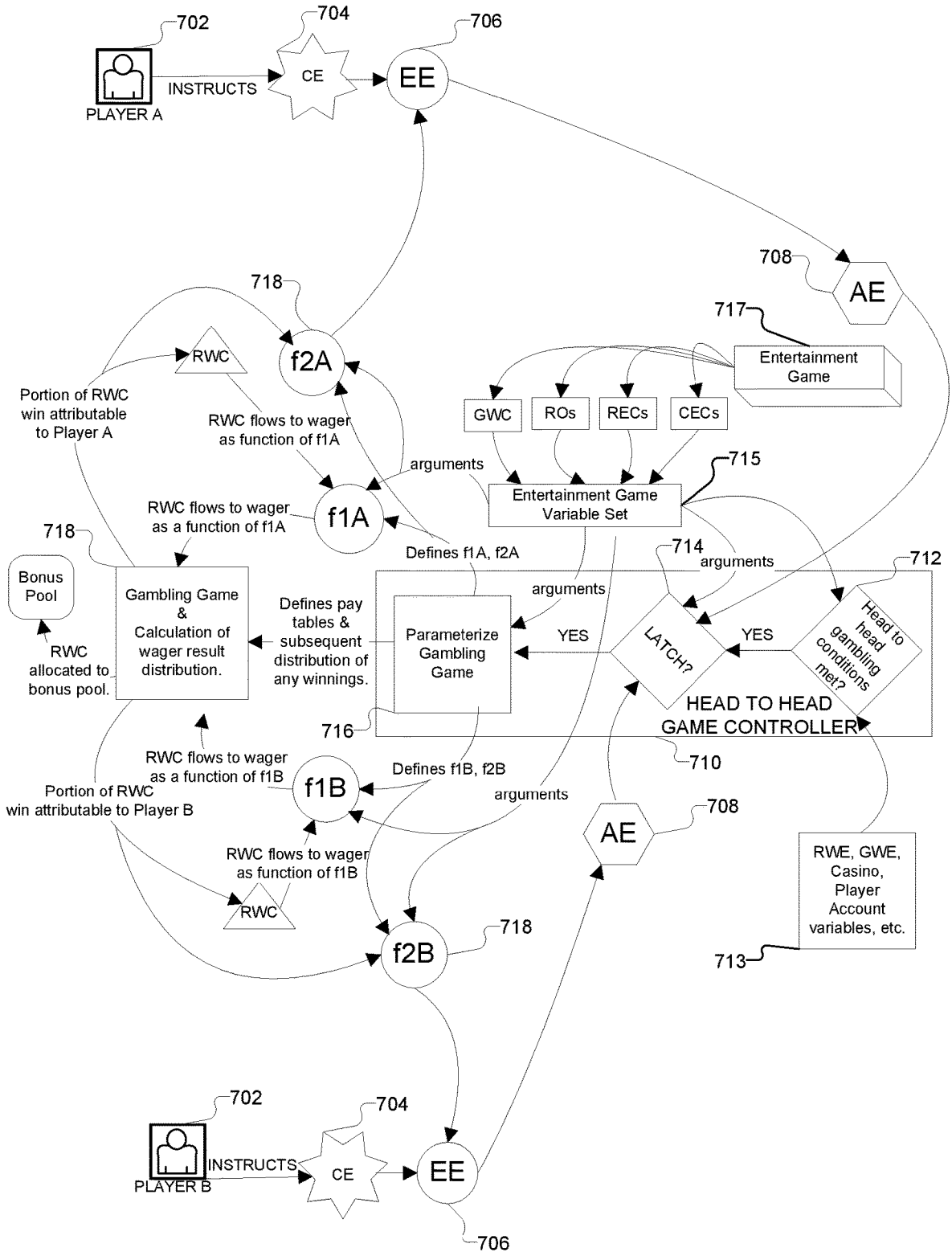
FIG. 7 is a conceptual diagram that illustrates a process of operating a head to head gambling hybrid game where two players enter the same gambling game in accordance with an embodiment of the invention.

Turning now to FIGS. 7, 8, 9, 10 and 11, where elements annotated with the same number are the same elements. A conceptual diagram that illustrates a process of operating a head to head gambling hybrid game where two players enter the same gambling game in accordance with an embodiment of the invention is illustrated in FIG. 7. The diagram illustrates that a player 702 can instruct a CE 704 to utilize EE 706 to perform an AE 708 in an entertainment game. At the same time, a GWE utilizes a head to head gambling controller 710 that monitors an entertainment game to determine whether the conditions that enable head to head gambling are present 712. The conditions to determine if head to head gambling is enabled may be based upon input from the entertainment game variable set 713, the RWE, GWE, casino player account variables, etc. If head to head gambling is enabled, the head to head gambling controller monitors the entertainment game for a latch event 714. The detection of a latch event initializes a head to head gambling session by parameterizing 716 wager terms made in the head to head gambling session 718 based upon entertainment game gameplay information, such as the entertainment game variable set 715 including but not limited to GWC, ROs, RECs and CECs of entertainment game 717. In the illustrated embodiment, the head to head gambling session 710 can include a single gambling game played amongst each of the players of the head to head hybrid game. In many embodiments, the head to head game controller 710 may define pay tables and subsequent distributions of any winnings to the single gambling game 718. The single gambling game 718 may allocate RWC to a bonus pool. RWC flows to wager as a function of f1A (for player A) and f1B (from player B). The single gambling game 718 includes calculation of wager result distribution to determine the portion of RWC win attributable to player A and player B.

Figure 8:
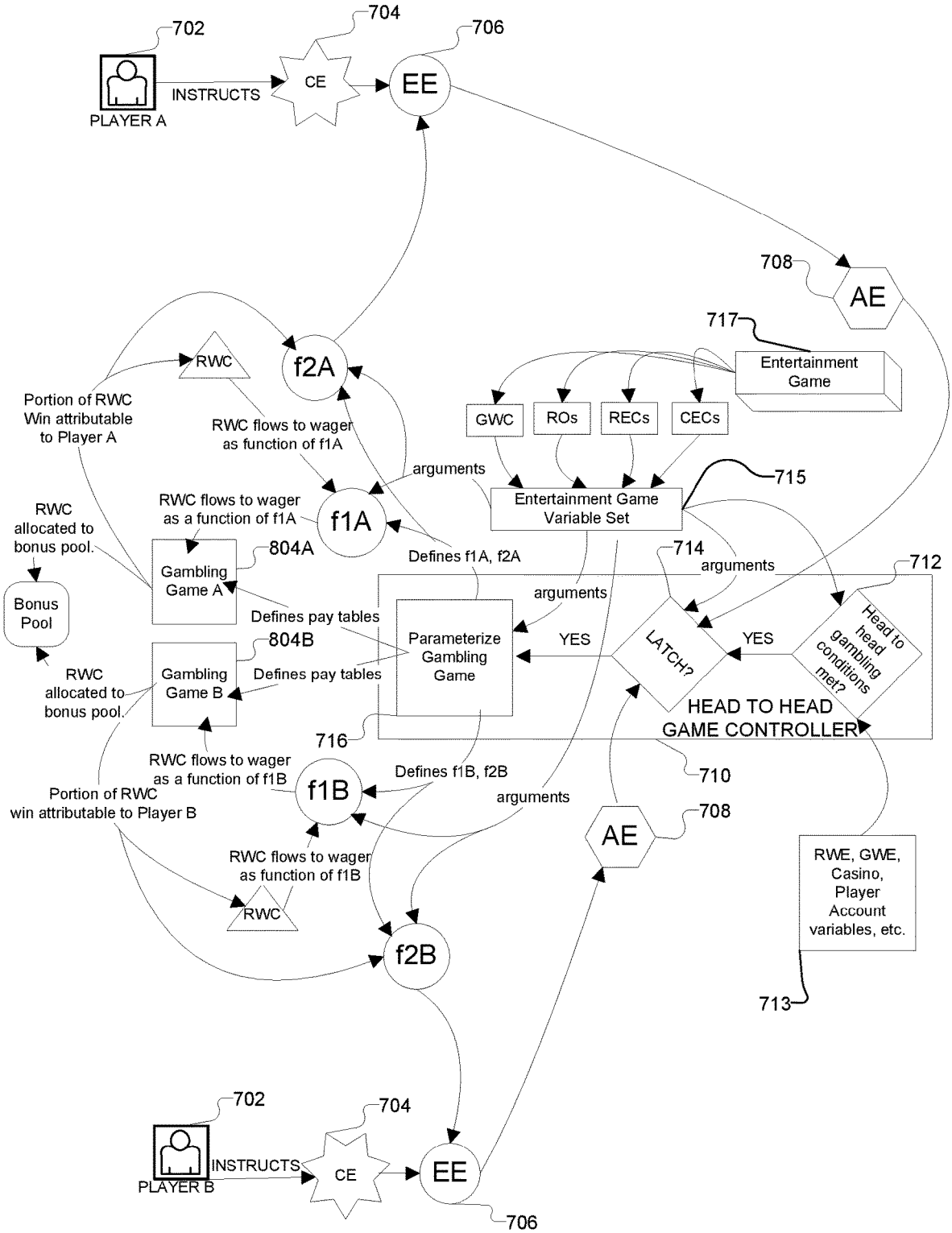
FIG. 8 is a conceptual diagram that illustrates a process of operating a head to head gambling hybrid game where two players enter different gambling games in accordance with an embodiment of the invention.

In a number of embodiments, each player in a head to head gambling session can also engage in separate gambling games. Each gambling game of the head to head gambling session can have the same or different wager terms. Also, each gambling game can be independent to each other or dependent on each other, such as where the result of a first gambling game serves as an input to a second gambling game or vice versa. A conceptual diagram that illustrates a process of operating a head to head gambling hybrid game where two players enter different gambling games in accordance with an embodiment of the invention is illustrated in FIG. 8. The diagram in FIG. 8 illustrates that each player enters a different gambling game 804A and 804B in a head to head gambling session, in contrast with each player entering the same gambling game as illustrated in FIG. 7.

Figure 9:
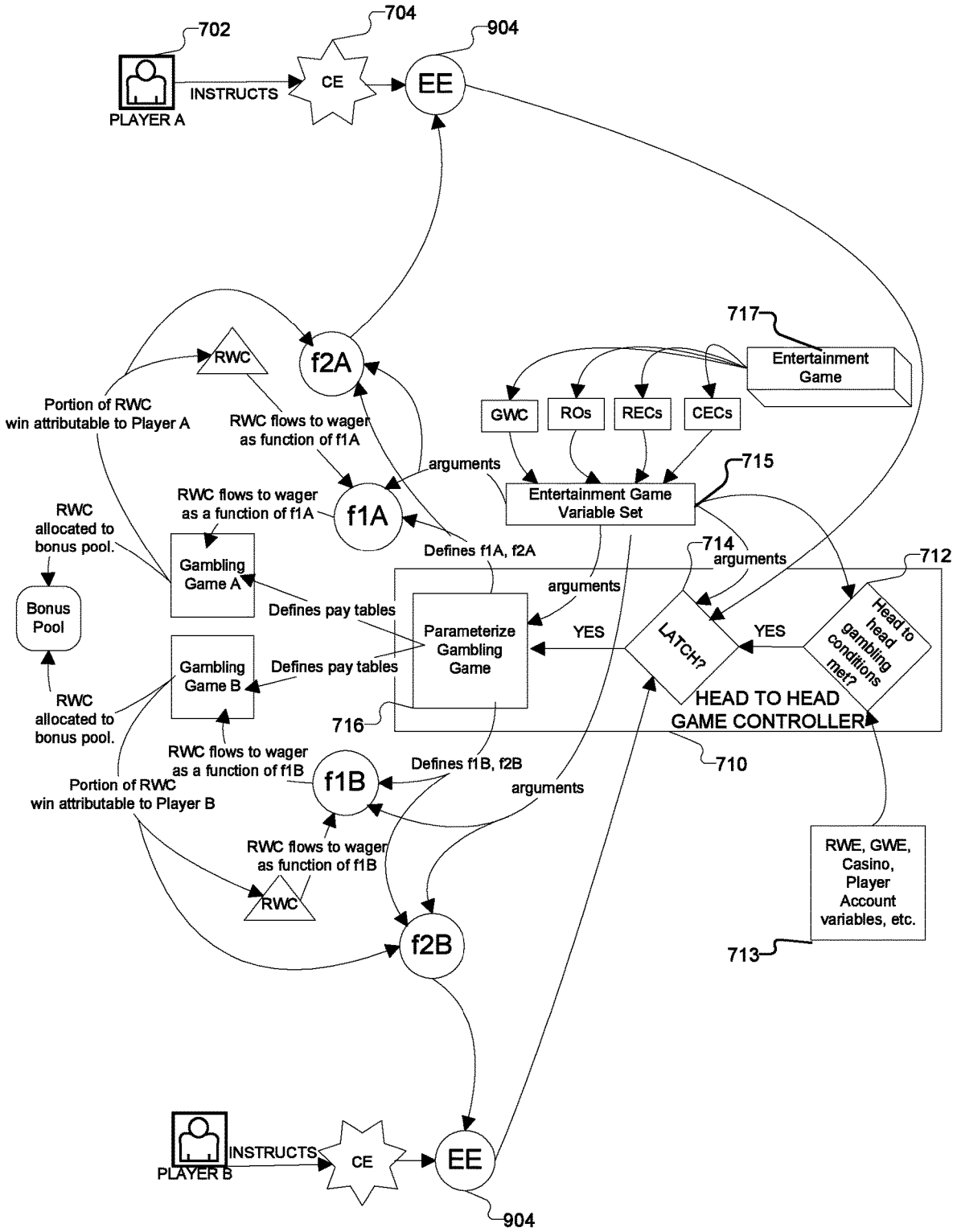
FIG. 9 is a conceptual diagram that illustrates a process of operating a head to head gambling hybrid game where a latch event does not require usage of an actionable element in accordance with an embodiment of the invention.

In several embodiments, a latch event may not require utilization of an AE. A conceptual diagram that illustrates a process of operating a head to head gambling hybrid game where a latch event does not require usage of an actionable element in accordance with an embodiment of the invention is illustrated in FIG. 9. The diagram in FIG. 9 illustrates that the latch event only monitors EE 904, in contrast with the latch event requiring AE in order to occur as illustrated in FIG. 8.

Although various constructions of head to head gambling controllers and methods for conducting head to head gambling sessions are discussed above, head to head gambling controllers can be constructed to conduct head to head gambling sessions in various ways as appropriate to the requirements of a specific application in accordance with embodiments of the invention. Implementations of various entertainment game gameplay themes are discussed below.

Head to Head Gambling Hybrid Game Gameplay

Head to head gambling hybrid games in accordance with many embodiments of the invention can be utilized to facilitate head to head gambling sessions with various entertainment games of different themes. In certain embodiments, a head to head gambling controller can facilitate head to head gambling sessions in a Wild West shootout themed entertainment game. In the Wild West shootout themed entertainment game, two players can participate whereby each is a sheriff's deputy in the same small frontier town. The conditions for initiating head to head gambling can be as follows (by way of example): a player elects to participate in a head to head gambling session, an operator enables head to head gambling sessions and the players' CEs are present at the same shootout on a ranch outside of town.

When the enablement conditions are present, the head to head gambling controller monitors the entertainment game for a latch event, such as when both players fire a bullet (EE) from their gun at each other. When the latch event occurs, the head to head gambling controller will initiate a head to head gambling session with wager terms parameterized utilizing entertainment game gameplay information, such as the entertainment game variable set of each player participating in the head to head gambling session. A player's entertainment game variable set can include information concerning (but not limited to) each player's skill level, the type of weapon used in the context of the entertainment game and the health points of each players' CE. Parameterization can also cause RWC to be allocated to the gambling game from each player's player profile for use in a gambling game in accordance with entertainment game gameplay information. Similarly, the payouts for the gambling game and/or the entertainment game resulting from wagers made in gambling games of the head to head gambling session can also be allocated back to the players in accordance with each player's entertainment game variable set.

In several embodiments, a head to head gambling controller can facilitate head to head gambling sessions in a creative thinking based party game, such as Scattegories produced by Hasbro Inc. of Pawtucket, R.I. In a Scattegories inspired head to head gambling hybrid game, two or more competitors compete to identify a words or phrase beginning with a specific letter within each of twelve categories within a limited period of time (such as but not limited to one, two or three minutes). Each player undertakes the activity in the context of a list, which is the same for all players, and which changes with each round. Points can be awarded for each word or phrase provided that is not duplicated by another player. A maximum of 12 points can be earned by a player in any given round.

In certain embodiments, players begin by being matched with other players of an appropriate skill level. The players can also agree upon the amount of RWC to attribute to each line in the game. A line is an entry whereby a player records the word or phrase that the player identifies in association with the category provided. In particular embodiments, the players can agree that each line (EE) will cause one unit of RWC to be committed to a head to head gambling session. Each player also dictates the time available for each round of the game. Each player then enters an amount of RWC for utilization during gameplay (such as but not limited to entering that a minimum of 12 units of RWC is required to commence game play). Once the head to head gambling hybrid game is set up, entertainment gameplay can commence.

In many embodiments, an entertainment game can utilize a RNG to generate the letter for the first round, such as but not limited to the letter N. Each player is then shown the same list by the ESE. In certain embodiments, the list has the following twelve entries: (1) an item of clothing, (2) an animal, (3) candy, (4) something you pick up on the way out of the house, (5) a part of a car, (6) a tool, (7) something kids don't like, (8) a color, (9) a country, (10) something that grows, (11) a film and (12) something you dream about. Once the list is shown, each player commences entering answers independently.

In certain embodiments, a player A selects one minute for a round, has sixty seconds to provide the twelve words or phrases in that round while a player B selects two minutes for a round.

In particular embodiments, possible resulting entries from the players are listed in the following table:

Table of player entries in a Scattegories themed game

| Line Number | Player A | Player B |
|---|---|---|
| 1 | Necktie | Negligee |
| 2 | Narwhale | |
| 3 | Necco Wafer | Necco Wafer |
| 4 | | |
| 5 | | Nuts and bolts |
| 6 | Nibbler | |
| 7 | Nitpicking | Nightmares |
| 8 | Neon | Navy Blue |
| 9 | Nigeria | Norway |
| 10 | | Nightcrawler |
| 11 | NeverEnding Story | Napolean Dynamite |
| 12 | Nighttime | Nachos |

At the conclusion of the one minute, player A that selected one minute for a round is asked to wait for a latch event when both players' times for a round have transpired. After two minutes, both players can no longer input information and the head to head gambling controller detects that a latch event has occurred and parameterizes wager terms in a head to head gambling session.

In certain embodiments, wager terms in a gambling game can be parameterized according to the following rules: if both players provide dissimilar answers they contribute RWC equally to a medium return/medium risk gambling game; if both players provide the same answer, each player contributes equally to a gambling game with a low return/high risk profile; if one player provides an answer and the other does not, the first player plays a gambling game with a medium return/medium risk profile. Also, any RWC payout won as a function of the gambling games in a head to head gambling session can be divided 55/45 in favor of player A that elected only one minute for a round lieu of two minutes per round.

In particular embodiments, the parameterization can yield that a series of 11 gambling games can be parameterized by the head to head gambling controller and run by the RWE due to line 4 is totally blank). This is due to player A and player B consuming nine lines (EE), which in turn causes nine units of RWC to be committed to gambling games by each party, or units 18 of RWC in total. In certain embodiments after these gambling games are executed, player A can receive a payout of 13 RWC and is enabled to utilize 13 lines (EE) in the next round while Player B receives a payout of 7 RWC and is enabled to utilize 7 lines (EE) in the next round. Therefore, in the next round of the entertainment game, player B will only be able to play seven lines unless player B adds more RWC for gameplay use.

In several embodiments, each round of a Scattegories themed head to head gambling hybrid game also causes the players to accumulate GWC. In certain embodiments, the amount of GWC rewarded is equivalent to the number of lines that were correctly filled out and which were not duplicated by the other players.

In a number of embodiments, each player of a Scattegories themed head to head gambling hybrid game participates in an independent, rather than joint gambling games, but these gambling games are characterized as a function of the choices and performance in the entertainment game of both players. In certain embodiments, each independent gambling game of a head to head gambling session is parameterized according to the following rules, which can apply to each line: if both players provide different answers they each participate in an independent medium return/medium risk gambling game; if both players provide the same answer, each player participates in a gambling game with a low return/high risk profile; if one player provides an answer and the other does not, the first player plays a gambling game with a high return/low risk profile while the second player does not play a gambling game associated with the blank line; in all cases, choosing to complete a round in 1 minute will provide improved odds relative to taking two minutes to complete the round, and completing the round in two minutes will provide better odds than will taking three minutes.

In certain embodiments, two players can contribute RWC at the onset of entertainment game gameplay. Each line (EE) corresponds to three credits (RWC). At the onset of each round, players can or are required to commit a specified amount of EE to the round. During the round, the players enter their answers on each line. To the extent that they provide fewer answers than lines committed, the committed EE that went unused is lost to the player. In particular embodiments, if a player commits to 10 EE, but only provides seven answers, three EE are consumed without any prospect of triggering a gambling game. The RWC associated with that EE is kept by the house. And, in cases where a player has a blank line, and a second player has provided a valid answer, the pay tables for the gambling game for the second player in that instance are substantially improved.

Figure 10:
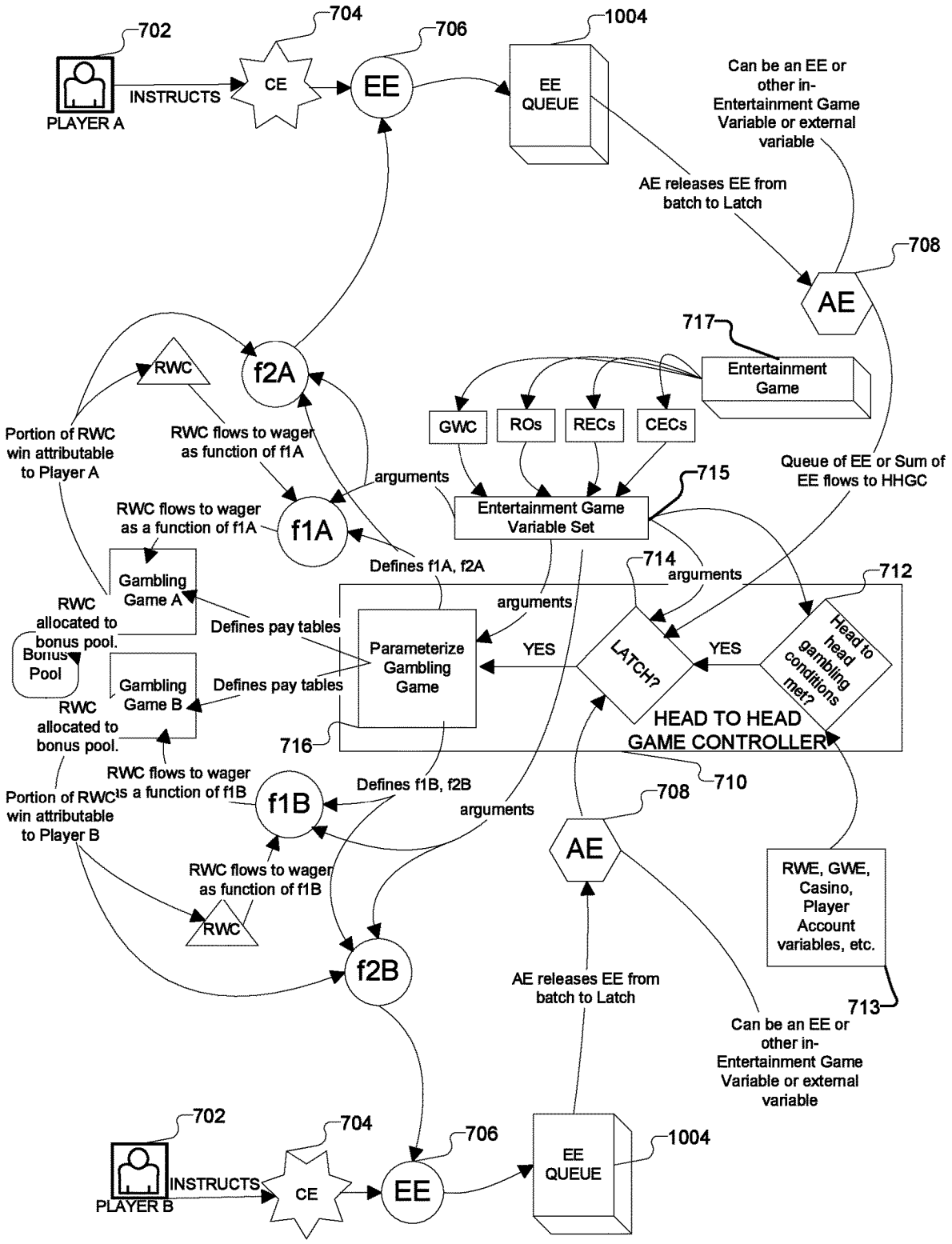
FIG. 10 is a conceptual diagram that illustrates a process of operating a head to head gambling hybrid game where enabling elements are stored in an enabling element queue in accordance with an embodiment of the invention.

A conceptual diagram that illustrates a process of operating a Scattegories themed head to head gambling hybrid game where enabling elements are stored in an enabling element queue in accordance with an embodiment of the invention is illustrated in FIG. 10. The diagram illustrates how a series of EE consumptions (such as, lines being filled out during a round) are batched, or queued 1004. Only when a specific in-game event takes place (such as but not limited to the end of a round, or the AE) are each of the queued EE consumptions advanced through the process by which each EE is converted into a specific amount of RWC that is gambled in a gambling game of a head to head gambling session.

In several embodiments, rather than a different AE releasing the queue of EE for each CE, a single AE can release multiple queues for multiple CEs. In certain embodiments, it is not an AE that is required to release the queue, but rather a different in-game event. In particular embodiments, a fixed number of EE can be accumulated in an EE queue and used in parameterization of a head to head gambling session upon occurrence of a latch event, such as (but not limited to) the end of the entertainment game (such as but not limited to when a CE's life is extinguished or an opposing player exits the game or surrenders), a specific type of EE taking place (such as but not limited to any EE that consumes three or more health points, the consumption of a potion, the firing of a bullet), or an operator initiated action. In certain embodiments, EE queuing does not release each EE stored in the EE queue but performs an operation upon the EE stored in the queue such that a different number or type of EE is released upon the release of EE from the EE queue.

In many embodiments, a head to head gambling controller can facilitate head to head gambling sessions in a boxing themed entertainment game. In a boxing themed entertainment game, two players can compete head to head in an entertainment game. A CE (such as but not limited to a CE themed as a boxer) under control of a player can perform actions in the entertainment game such as a punch or a parry. When a CE successfully lands a punch, GWC is earned. Similarly, when a CE is hit, GWC is lost. Each player's CE has a certain amount of stamina (EE) at the onset of the game. The amount of EE that each boxer has can be a function of the amount of RWC contributed to the game, and may also be a function of other factors, including, but not limited to, player history at the boxing themed entertainment game and/or other games, the history of this player's particular CE and the relative skill of each player as compared to an opponent. Every time a CE attempts to punch an opponent, whether the punch is landed or not, stamina is consumed (EE). Different types of punches consume more or less EE. Likewise, every time a CE is hit by a punch, stamina is consumed (EE), in this case a function of the type of punch landed, and the extent to which the CE who was hit succeeded in defending or deflecting the punch. EE is also consumed as a function of CE movement in general (such as but not limited to a boxer continuously backing away from an attacking opponent will consume a measure of EE).

In many embodiments, EE consumed is added to a running total for that CE (in the EE Queue) until an AE occurs, such as (but not limited to) a punch landed by one CE upon the other. The head to head gambling controller recognizes the AE as a latch event, and the EE sum from each EE queue is released and utilized to parameterize wager terms in the gambling games of a head to head gambling session. Parameterization can include converting EE into RWC in accordance to rules that govern how EE in an entertainment game translates into RWC available in a gambling game. Similarly, parameterization can include converting RWC from a payout into EE in an entertainment game that can be utilized by a CE.

The following table displays types the amount of stamina (EE) consumed by player A and player B as a result of various in-game actions combined with characteristics of a CE:

Table of types of EE based in a boxing themed game

| EE Action Types | Stamina (EE) Consumed A | Stamina (EE) Consumed B |
|---|---|---|
| Right hook-attempt | 3 | 2 |
| Left hook-attempt | 2 | 3 |
| Right jab-attempt | 3 | 2 |
| Left jab-attempt | 2 | 3 |
| Right upper cut-attempt | 3 | 2 |
| Left upper cut-attempt | 2 | 3 |
| Right hook hit | 2 | 3 |
| Left hook hit | 2 | 3 |
| Right jab hit | 2 | 2 |
| Left jab hit | 2 | 2 |
| Right upper cut hit | 2 | 3 |
| Left upper cut hit | 2 | 3 |
| Block punch | 2 | 1 |
| Deflect punch | 2 | 1 |
| Back away | 2 | 1 |

The table illustrates how player A's CE reflects a stronger, slower moving, heavier hitting fighter with a left-hand bias. As a result the CE associated with player A consumes more EE in attempting right handed punches than left handed punches. Also, the CE also consumes less EE when hit by upper cuts and hooks given the CE's greater strength and durability. At the same time, the CE's slower reflexes and lower agility means that that the CE consumes more EE to block or deflect punches or to back away. Similarly, player B's CE reflects a right-handed CE with high agility, more endurance but less punching power and a lower pain threshold. As such, Player B's CE consumes more stamina (EE) to attempt left handed hooks and upper cuts, takes more damage from punches landed, and uses less stamina to defend punches or back away from punches. Although a specific table is illustrated above, any of a variety of tables can be utilized in boxing and/or similarly themed hybrid games as appropriate to the specific hybrid game in accordance with embodiments of the invention.

Upon commencing entertainment game gameplay, stamina points (EE) consumed are stored in an EE queue until an event occurs that causes a release of EE in an EE queue back to for the CE's consumption, such as but not limited to when a punch is landed or a player is out of stamina points or when a certain amount of time has elapsed. The following table displays types the amount of stamina (EE) stored in an EE queue by player A and player B. An example of the contents of the EE Queues for CE A and B might be as follows:

Table of types of EE stored in an EE queue for player A

| Queue # | Description | EE(A) |
|---|---|---|
| 1 | Right hook-attempt | 3 |
| 2 | Left hook-attempt | 2 |
| 3 | Left jab-attempt | 2 |
| 4 | Back away | 2 |
| 5 | Left hook-attempt | 2 |

Table of types of EE stored in an EE queue for player B

| Queue # | Description | EE(B) |
|---|---|---|
| 1 | Deflect punch | 1 |
| 2 | Block punch | 1 |
| 3 | Back away | 1 |
| 4 | Left upper cut-attempt | 3 |
| 5 | Left upper cut hit | 3 |

In certain embodiments, a latch event occurs when an left upper cut attempted by A is landed on B and a head to head gambling session is triggered with wagers terms from two gambling games (one each for player A and player B) parameterized. In the case of player A, a total of 11 EE are consumed, which will be translated into a specific amount of RWC to be wagered in a gambling game for player A. For player B, nine EE is consumed which is also translated into a specific amount of RWC wagered in a gambling game for player B. Also, as this sequence led to a hit on player B by player A, the pay tables for the gambling game that player A is participating in yields better odds than those for the gambling game that player B is participating in. Other factors utilized in parameterizing wager terms in a head to head gambling session can include (but is not limited to) the nature of the CEs (such as but not limited to how many matches a given CE has participated in during the CE's career), and the players (such as but not limited to how much money the players have spent in the head to head gambling hybrid game in the past year). A gambling game payout can include a win of four units of RWC for player A and a loss of three units of RWC for player B. These payouts from the gambling game can be converted in stamina points in the form of reserve EE, which is stored for each player to be released at the end of the boxing round.

Figure 11:
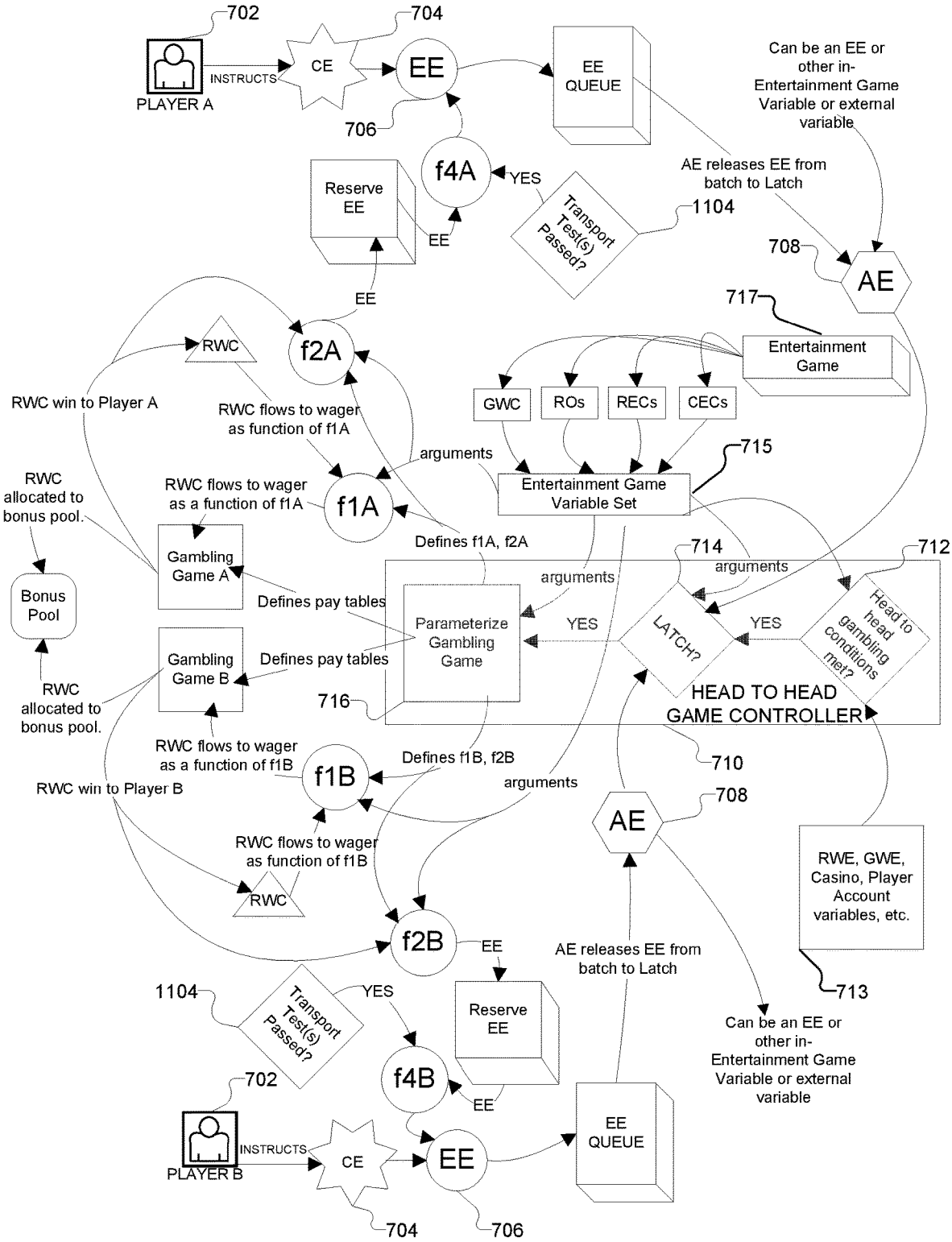
FIG. 11 is a conceptual diagram that illustrates a process of operating a head to head gambling hybrid game where transport testing is utilized to determine when reserve enabling elements are released to entertainment game gameplay in accordance with an embodiment of the invention.

In several embodiments, transport tests (such as but not limited to a determination if the CE in question even made it to the end of the round) can be utilized to determine how reserve EE is converted into EE consumable by the CE as stamina points. A transport test is a test of the head to head gambling hybrid game that determines whether the reserve EE can be utilized as EE available to a player at an entertainment game. A conceptual diagram that illustrates a process of operating a head to head gambling hybrid game where transport testing is utilized in accordance with an embodiment of the invention is illustrated in FIG. 11. The diagram in FIG. 11 illustrates that a transport test 1104 is utilized to determine whether reserve EE earned in a payout of a head to head gambling game session can be released to be utilized as EE by a player in an entertainment game.

In certain embodiments, a head to head gambling controller can continue to detect latch events until head to head gambling is deactivated, such as (but not limited to) when one of the CEs is knocked out, the end of the fight is reached, one of the players withdraws from the game, or one of the players runs out of RWC to support ongoing gambling and/or to fund a non-gambling participation in the game.

In several embodiments, a bonus pool function can be utilized where a portion of RWC paid out from each gambling game can be contributed to a pool that can be awarded to the player that wins the overarching entertainment game.

Although various entertainment game gameplay themes are discussed above, head to head gambling sessions can be conducted with different entertainment game gameplay themes that parameterize wager terms utilizing entertainment game gameplay information in any manner as appropriate to the requirements of a specific application in accordance with embodiments of the invention. In certain embodiments, head to head gambling sessions can be conducted utilizing different tests for head to head gambling session enablement, latch events, wager terms, or entertainment game gameplay information as appropriate for a specific gameplay theme. A discussion of a processing apparatus that can be implemented in a head to head gambling hybrid game is discussed below.

Processing Apparatus

Figure 12:
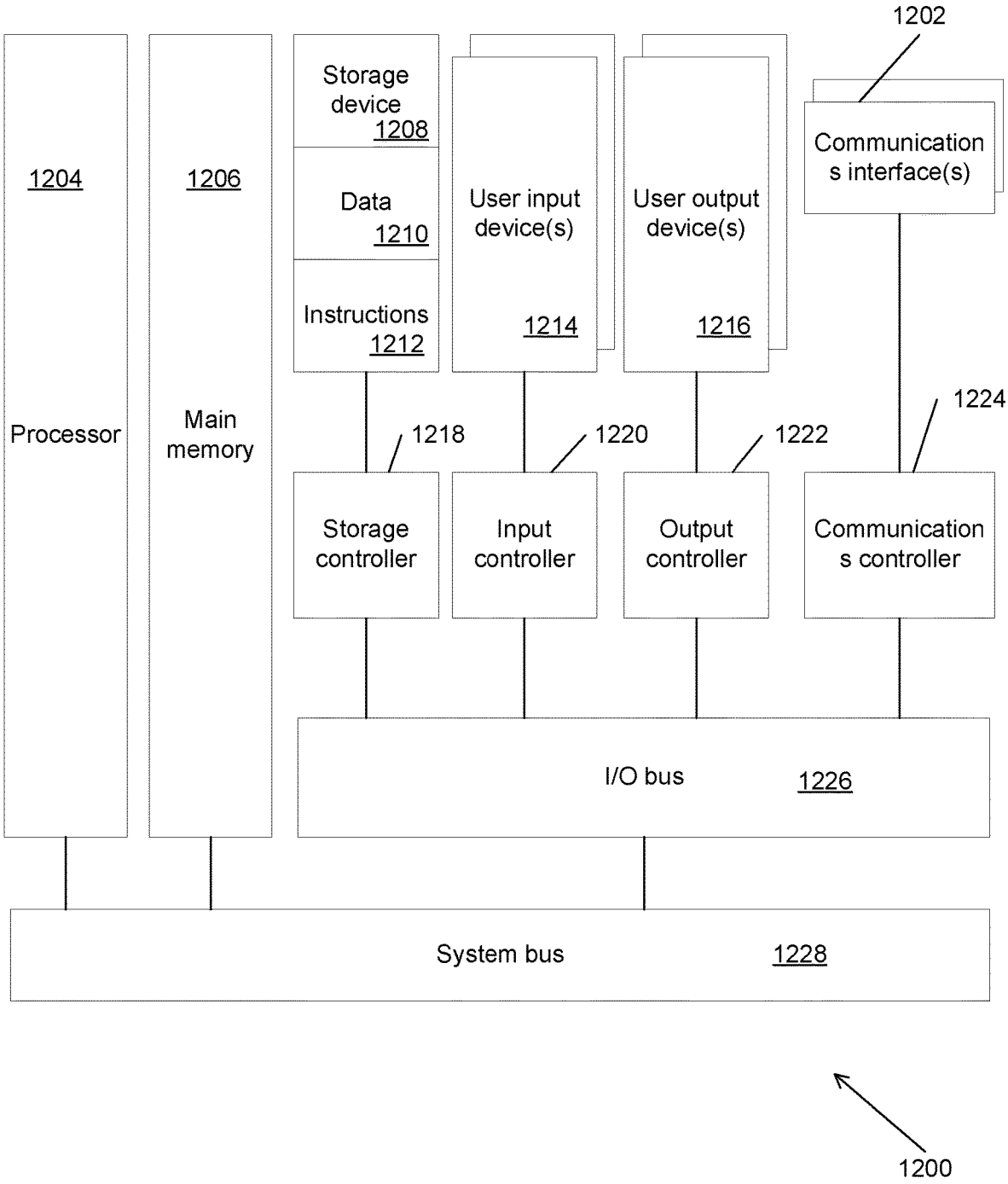
FIG. 12 illustrates a hardware architecture diagram of a processing apparatus utilized in the implementation of a head to head gambling hybrid game in accordance with an embodiment of the invention.

Any of a variety of processing apparatuses can host various components of a head to head gambling hybrid game in accordance with embodiments of the invention. In several embodiments, these processing apparatuses can include, but are not limited to, a gaming machine, a general purpose computer, a computing device and/or a controller. A processing apparatus that is constructed to implement a head to head gambling hybrid game in accordance with an embodiment of the invention is illustrated in FIG. 12. In the processing apparatus 1200, a processor 1204 is coupled to a memory 1206 by a bus 1228. The processor 1204 is also coupled to non-transitory processor-readable storage media, such as a storage device 1208 that stores processor-executable instructions 1212 and data 1210 through the system bus 1228 to an I/O bus 1226 through a storage controller 1218. The processor 1204 is also coupled to one or more interfaces that may be used to connect the processor to other processing apparatuses as well as networks as described herein. The processor 1204 is also coupled via the bus to user input devices 1214, such as tactile devices including but not limited to keyboards, keypads, foot pads, touch screens, and/or trackballs, as well as non-contact devices such as audio input devices, motion sensors and motion capture devices that the processing apparatus may use to receive inputs from a user when the user interacts with the processing apparatus. The processor 1204 is connected to these user input devices 1214 through the system bus 1228, to the I/O bus 1226 and through the input controller 1220. The processor 1204 is also coupled via the bus to user output devices 1216 such as (but not limited to) visual output devices, audio output devices, and/or tactile output devices that the processing apparatus uses to generate outputs perceivable by the user when the user interacts with the processing apparatus. In several embodiments, the processor is coupled to visual output devices such as (but not limited to) display screens, light panels, and/or lighted displays. In a number of embodiments, the processor is coupled to audio output devices such as (but not limited to) speakers, and/or sound amplifiers. In many embodiments, the processor is coupled to tactile output devices like vibrators, and/or manipulators. The processor is connected to output devices from the system bus 1228 to the I/O bus 1226 and through the output controller 1222. The processor 1204 can also be connected to a communications interface 1202 from the system bus 1228 to the I/O bus 1226 through a communications controller 1224.

In various embodiments, a processor loads the instructions and the data from the storage device into the memory and executes the instructions and operates on the data to implement the various aspects and features of the components of a gaming system as described herein. The processor uses the user input devices and the user output devices in accordance with the instructions and the data in order to create and operate user interfaces for players, casino operators, and/or owners as described herein.

Although the processing apparatus is described herein as being constructed from a processor and instructions stored and executed by hardware components, the processing apparatus can be composed of only hardware components in accordance with many embodiments. In addition, although the storage device is described as being coupled to the processor through a bus, those skilled in the art of processing apparatuses will understand that the storage device can include removable media such as but not limited to a USB memory device, an optical CD ROM, magnetic media such as tape and disks. Also, the storage device can be accessed through one of the interfaces or over a network. Furthermore, any of the user input devices or user output devices can be coupled to the processor via one of the interfaces or over a network. In addition, although a single processor is described, those skilled in the art will understand that the processor can be a controller or other computing device or a separate computer as well as be composed of multiple processors or computing devices.

In numerous embodiments, any of an RWE, GWE or ESE as described herein can be implemented on multiple processing apparatuses, whether dedicated, shared or distributed in any combination thereof, or may be implemented on a single processing apparatus. In addition, while certain aspects and features of element management processes described herein have been attributed to an RWE, GWE, or ESE, these aspects and features may be implemented in a hybrid form where any of the features or aspects may be performed by any of a RWE, GWE, ESE within a head to head gambling hybrid game without deviating from the spirit of the invention.

While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. An electromechanical gaming machine constructed to receive currency, comprising:

a real world controller connected to a game world controller, wherein the real world controller is constructed to:

accept from the game world controller, a trigger to run a gambling game; and distribute to the game world controller, in response to the trigger, a randomly generated payout of real world credits from a wager in the gambling game; and the game world controller connected to the real world controller and connected by a network to an entertainment software controller executing a multiplayer entertainment game, wherein the game world controller is constructed to:

receive from the entertainment software controller via the network, a plurality of players' actions taken during the plurality of players' execution of the multiplayer entertainment game; and trigger the wager in the gambling game based on the players' actions taken during the plurality of players' execution of the multiplayer entertainment game, wherein the game world controller utilizes a gambling controller constructed to:

enter the plurality of players into a multiplayer simultaneous gambling session;

parameterize wager terms of the wager made in the gambling game based on information associated with each of the plurality of players entered into the multiplayer simultaneous gambling session;

trigger the wager in the gambling game during the multiplayer simultaneous gambling session based on the plurality of players' actions;

distribute the randomly generated payout of real world credits as a result of the wager in the gambling game during the multiplayer simultaneous gambling session between the plurality of players of the multiplayer entertainment game entered into the multiplayer simultaneous gambling session;

determine a payout of resources utilized by the plurality of players in the multiplayer entertainment game gameplay session based on the result of the wager; and distribute to the entertainment software controller via the network, the payout of resources for utilization by the plurality of players in the entertainment game during the multiplayer entertainment game gameplay session.

2. The electromechanical gaming machine of claim 1, wherein the wager terms further include odds of return for wagers in a pay table.

3. The electromechanical gaming machine of claim 1, wherein the information related to gameplay within the multiplayer entertainment game gameplay session is a multiplayer entertainment game variable set, which includes aspects of the multiplayer entertainment game that can vary during gameplay progression.

4. The electromechanical gaming machine of claim 3, wherein the multiplayer entertainment game variable set includes game world credits earned by the plurality of players entered into the multiplayer simultaneous gambling session.

5. The electromechanical gaming machine of claim 3, wherein the multiplayer entertainment game variable set includes at least one variable selected from the group consisting of enabling elements that are limited resources whose consumption enables the plurality of player's play of the multiplayer entertainment game, actionable elements that trigger the wager in the gambling game when acted upon, required objects in the multiplayer entertainment game necessary for an actionable element to be acted upon, required environmental conditions that are a game state necessary within the multiplayer entertainment game for an actionable element to be acted upon and controlled entity characteristics for a status necessary for a controlled entity associated with a player for an actionable element to be acted upon.

6. The electromechanical gaming machine of claim 1, wherein the gambling controller is further constructed to conduct the multiplayer simultaneous gambling session for the plurality of players after determining whether the multiplayer simultaneous gambling session is enabled.

7. The electromechanical gaming machine of claim 1, wherein a player of the plurality of players is an electronic representation of interactions associated with a player profile.

8. The electromechanical gaming machine of claim 1, wherein the gambling controller is further constructed to execute on the game world controller.

9. The electromechanical gaming machine of claim 1, wherein the gambling controller is further constructed to execute on a gambling server and communicate with the game world controller via the network.

10. The electromechanical gaming machine of claim 1, wherein the real world controller and the game world controller are constructed using a same processing apparatus.

11. The electromechanical gaming machine of claim 1, wherein the real world controller and the game world controller are constructed using separate processing apparatuses, and wherein the real world controller and the game world controller are connected by the network.

12. An electromechanical gaming machine constructed to receive currency, comprising:

an entertainment software controller connected to a game world controller, wherein the entertainment software controller is constructed to:

execute a multiplayer entertainment game, the multiplayer entertainment game providing outcomes based upon a plurality of players' actions taken by the plurality of players' as the plurality of players compete against each other during execution of the multiplayer entertainment game to earn a payout of game world credits separately for each player of the plurality of players; and convey to the game world controller, the plurality of players' actions; and the game world controller connected to a real world controller by a network and connected to the entertainment software controller, wherein the game world controller is constructed to:

receive from the entertainment software controller, the plurality of players' actions taken during the plurality of players' execution of the multiplayer entertainment game; and trigger the wager in the gambling game based on the players' actions taken during the plurality of players' execution of the multiplayer entertainment game, wherein the game world controller utilizes a gambling controller constructed to:

enter the plurality of players into a multiplayer simultaneous gambling session;

parameterize wager terms of the wager made in the gambling game based on information associated with each of the plurality of players entered into the multiplayer simultaneous gambling session;

trigger the wager in the gambling game via the network during the multiplayer simultaneous gambling session;

distribute a randomly generated payout of real world credits as a result of the wager in the gambling game during the multiplayer simultaneous gambling session between the plurality of players of the multiplayer entertainment game entered into the multiplayer simultaneous gambling session;

determine a payout of resources utilized by the plurality of players in the multiplayer entertainment game gameplay session based on the result of the wager;

and distribute the payout of resources for utilization by the plurality of players in the entertainment game during the multiplayer entertainment game gameplay session.

13. The electromechanical gaming machine of claim 12, wherein the wager terms further include odds of return for wagers in a pay table.

14. The electromechanical gaming machine of claim 12, wherein the information related to gameplay within the multiplayer entertainment game gameplay session is a multiplayer entertainment game's variable set, which includes aspects of the multiplayer entertainment game that can vary during gameplay progression.

15. The electromechanical gaming machine of claim 14, wherein the multiplayer entertainment game variable set includes game world credits earned by the plurality of players entered into the multiplayer simultaneous gambling session.

16. The electromechanical gaming machine of claim 12, wherein the gambling controller is further constructed to conduct the multiplayer simultaneous gambling session for the plurality of players after determining whether the multiplayer simultaneous gambling session is enabled.

17. The electromechanical gaming machine of claim 12, wherein the gambling controller is further constructed to execute on the game world controller.

18. The electromechanical gaming machine of claim 12, wherein the gambling controller is further constructed to execute on a gambling server and communicate with the game world controller via the network.

19. The electromechanical gaming machine of claim 12, wherein the game world controller and the entertainment software controller are constructed using a same processing apparatus.

20. An electromechanical gaming machine constructed to receive currency, comprising:

a game world controller connected to a real world controller by a network and connected to an entertainment software controller, wherein the game world controller is constructed to:

receive from the entertainment software controller, a plurality of players' actions taken during the plurality of players' execution of the multiplayer entertainment game; and trigger the wager in the gambling game based on the players' actions taken during the plurality of players' execution of the multiplayer entertainment game, wherein the game world controller utilizes a gambling controller constructed to:

enter the plurality of players into a multiplayer simultaneous gambling session;

parameterize wager terms of the wager made in the gambling game based on information associated with each of the plurality of players entered into the multiplayer simultaneous gambling session;

trigger the wager in the gambling game via the network during the multiplayer simultaneous gambling session;

distribute a randomly generated payout of real world credits as a result of the wager in the gambling game during the multiplayer simultaneous gambling session between the plurality of players of the multiplayer entertainment game entered into the multiplayer simultaneous gambling session;

determine a payout of resources utilized by the plurality of players in the multiplayer entertainment game gameplay session based on the result of the wager;

and distribute the payout of resources for utilization by the plurality of players in the entertainment game during the multiplayer entertainment game gameplay session.

* * * * *